US006531930B2

(12) United States Patent
Horio et al.

(10) Patent No.: US 6,531,930 B2
(45) Date of Patent: Mar. 11, 2003

(54) NON-RECIPROCAL CIRCUIT ELEMENT HAVING A GROUNDING LAND BETWEEN INPUT/OUTPUT PATTERNS

(75) Inventors: Yasuhiko Horio, Osaka (JP); Takayuki Takeuchi, Ibaraki (JP); Masumi Hattori, Hirakata (JP); Hiroyuki Hase, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/040,064

(22) Filed: Jan. 4, 2002

(65) Prior Publication Data

US 2002/0089390 A1 Jul. 11, 2002

Related U.S. Application Data

(62) Division of application No. 09/406,260, filed on Sep. 24, 1999, now Pat. No. 6,396,361.

(30) Foreign Application Priority Data

Sep. 25, 1998 (JP) ..... 10-270858
Dec. 3, 1998 (JP) ..... 10-344613
Dec. 8, 1998 (JP) ..... 10-349108

(51) Int. Cl.[7] ..... H01P 1/383; H01P 1/36
(52) U.S. Cl. ..... 333/1.1; 333/24.2
(58) Field of Search ..... 333/1.1, 24.2

(56) References Cited

U.S. PATENT DOCUMENTS 4,236,125 A 11/1980 Bernard et al. ..... 333/1.1
5,159,294 A * 10/1992 Ishikawa et al. ..... 333/1.1

FOREIGN PATENT DOCUMENTS

JP 06-164212 A 6/1994 ..... H01P/1/383
JP 10-084203 A 3/1998 ..... H01P/1/36

* cited by examiner

*Primary Examiner*—Justin P. Bettendorf
(74) *Attorney, Agent, or Firm*—RatnerPrestia

(57) ABSTRACT

A non-reciprocal circuit element for transmitting a signal in one way or cyclically transmitting the signal by using circuit means having at least a ferrite (34), transmission lines (31, 32, and 33), and a capacitor (21), has:

at least two external input/output terminals (11 and 12) for transferring a signal to and from an external unit and at least one of external grounding terminals (13, 14, and 15) for grounding, wherein at least one (13) of the external grounding terminals is set between at least one set of the external input/output terminals (11 and 12).

4 Claims, 33 Drawing Sheets

NON-RECIPROCAL CIRCUIT ELEMENT HAVING A GROUNDING LAND BETWEEN INPUT/OUTPUT PATTERNS

This application is a divisional of U.S. patent application Ser. No. 09/406,260 filed Sep. 24, 1999 now U.S. Pat. No. 6,396,361.

BACKGROUND OF THE INVENTION

1. Field of the Invention

The present invention relates to a non-reciprocal circuit element used for a mobile communication unit including an automobile telephone or a portable telephone mainly used in a microwave band, particularly to an isolator and a circulator. Moreover, the present invention relates to a board on which non-reciprocal circuit elements are mounted.

2. Related Art of the Invention

Because a LUMPED ELEMENT TYPE isolator can be compactly configured as a non-reciprocal element circuit used for a terminal of a mobile communication unit, it has been early used and further compacted and decreased in loss.

Conventionally, an isolator has been set between a power amplifier and an antenna at a transmission stage in order to prevent an unnecessary signal from being returned to the power amplifier and stabilize the impedance at the load side of the power amplifier. Characteristics required for an isolator include a large backward loss required for the above functions and a small forward loss for reducing the power consumption at a transmission stage and lengthening the service life of a battery. Therefore, the improvement of characteristics of an isolator has been concentrated on how to improve the above characteristics in a frequency band used.

Because terminal units have been suddenly downsized recently, it is attempted not only to downsize the parts used but also to reduce the number of parts by using a multifunctional part. In case of an isolator, it is attempted to downsize the single product and moreover, it is attempted to secure the attenuation at a frequency higher than the frequency band used for the isolator and omit an LPF (Low Pass Filter) used for a transmission stage by adding functions of the LPF to the isolator.

However, because it has been difficult so far to add functions of an LPF to an isolator without deteriorating the characteristic of a frequency band used for the isolator, there has been a problem on practical use.

It is an object of the first aspect of the present invention to provide an isolator added with LPF functions without deteriorating the characteristic of a conventional frequency band used for the isolator in order to solve the above conventional problems.

The general configuration of a LUMPED ELEMENT TYPE isolator widely used for terminals of portable telephones at present will be briefly described below by referring to FIG. 31. Three sets of strip lines 61A*a*, 61A*b*, 61A*c* electrically insulated, crossed at an angle of 120°, and overlapped each other are arranged on a ferrite disk 62A, and a magnet 63A for magnetizing the ferrite disk 62A is set so as to face the ferrite disk 62A. One ends of the strip lines 61A*a* and 61A*b* are connected with input/output terminals 65A*a* and 65A*b* and one end of the strip line 61A*c* is terminated by a predetermined resistance 66A.

Moreover, capacitors 64A*a*, 64A*b*, and 64A*c* are added to one ends of the strip lines 61A*a*, 61A*b*, and 61A*c* in parallel with the input/output terminals 65A*a* and 65A*b* or the resistance 66A. Moreover, the other ends of the strip lines 61A*a*, 61A*b*, and 61A*c* are respectively grounded. Then, an upper case 67A and a lower case 68A are set which serve as a part of a magnetic circuit and contain the ferrite disk 62A, the magnet 63A and the strip lines 61A*a*, 61A*b*, and 61A*c*.

It is described below that the upper case 67A and the lower case 68A serve as a part of the magnetic circuit. If neither upper case 67A nor lower case 68A are used, the magnetic flux emitted from one side of the magnet 63A returns to the other side of the magnet 63A after passing through an infinite route. However, when forming the upper case 67A and the lower case 68A with, for example, a magnetic material such as iron and covering the magnet 63A with the upper case 67A and the lower case 68A, the magnetic flux emitted from one side of the magnet 63A returns to the other side of the magnet 63A after passing through the upper case 67A and lower case 68A without passing through an infinite route. That is, the fact that the upper case 67A and lower case 68A serve as a part of the magnetic circuit represents returning the magnetic flux emitted from one side of the magnet 63A to the other side of the magnet 63A after making the magnetic flux pass through the upper case 67A and lower case 68A without making it pass through an infinite route.

Characteristics requested as performances of an isolator are a small forward transmission loss (insertion loss) and a large backward transmission loss (isolation). In FIG. 31, when assuming that the upper case 67A-side of the magnet 63A is N-pole and the lower case 68A-side of the magnet 68A is S-pole and most predetermined signals input to the input/output terminal 65A*a* are output from the input/output terminal 65A*b*, the direction from the input/output terminal 65A*a* toward the input/output terminal 65A*b*, that is, the transmission direction of the signals is the forward direction. That is, it is requested for an isolator that a signal output from the input/output terminal 65A*a* toward the input/output terminal 65A*b* has a small transmission loss and a signal output from the input/output terminal 65A*b* toward the input/output terminal 65A*a* has a large transmission loss. In practical use, the magnitude of insertion loss or isolation that can be assured in a desired frequency band is a problem. Because various improvements are attempted for an insertion loss and the peak value (minimum value) of the insertion loss is decreased, an insertion loss value that can be assured in a desired frequency band is also considerably lowered. However, because characteristics of an isolation are not adequate, the isolation of 15 dB or more recently required for the design of a portable telephone is not secured in a desired frequency band. That is, a band in which a desired isolation is secured is narrow before and after a desired frequency of a signal.

Moreover, the above conventional LUMPED ELEMENT TYPE isolator has the following problem.

That is, because the interval between the ferrite disk 62A and the case lower-side 68A is small, when the magnetic flux emitted from the permanent magnet 63A passes through the ferrite disk 62A through the case upper-side 67A and lower-side 68A of metallic magnetic materials, the magnetic flux density of the outer periphery of the ferrite disk 62A becomes higher than that of the central portion of the disk 62A and thereby, the magnetization distribution in the ferrite disk 62A is deteriorated.

The third aspect of the present invention is made to solve the problems of the above conventional isolator and its object is to provide a non-reciprocal circuit element having a superior transmission characteristic by improving the magnetization distribution in a ferrite disk and greatly reducing an insertion loss which-is an isolator characteristic.

SUMMARY OF THE INVENTION

To solve the above conventional problems, the first aspect of the present invention uses a non-reciprocal circuit element for transmitting a signal in one direction or cyclically transmitting a signal by using circuit means having at least a ferrite (34), transmission lines (31, 32, and 33), and a capacitor (21), comprising:

at least two external input/output terminals (11 and 12) for transferring a signal to and from an external unit and at least one of external grounding terminals (13, 14, and 15) to be grounded; wherein at least one (13) of the external grounding terminals is set between at least one set of external input/output terminals (11 and 12).

To solve the above conventional problems, the second aspect of the present invention has an object of providing a LUMPED ELEMENT TYPE isolator having a large isolation band width.

To attain the above object, the second aspect of the present invention uses a LUMPED ELEMENT TYPE isolator comprising:

a ferrite plate having a predetermined shape;

three strip lines arranged on the ferrite plate and overlapped each other while electrically insulated from each other;

a resistance whose one side is connected to one of the three strip lines and whose other end is grounded;

a magnet set on the three strip lines so as to face the ferrite plate to apply a DC magnetic field to the ferrite plate;

a predetermined grounding electrode; and a case for storing the ferrite plate, the three strip lines, the resistance, the magnet, and the grounding electrode to serve as a part of a magnetic circuit; wherein the case has an opening in the length-axis direction of the strip lines to which the resistance is connected on the ferrite plate, and at least a part of the case is electrically connected with the grounding electrode.

The third aspect of the present invention improves the magnetization distribution in a ferrite disk by setting a dielectric layer having a superior characteristic for a high frequency between a ferrite disk and a circular grounding plate and separating the lower case of a metallic magnetic material from the ferrite disk and reduces the insertion loss of an isolator.

DESCRIPTION OF SYMBOLS

Figure 1:
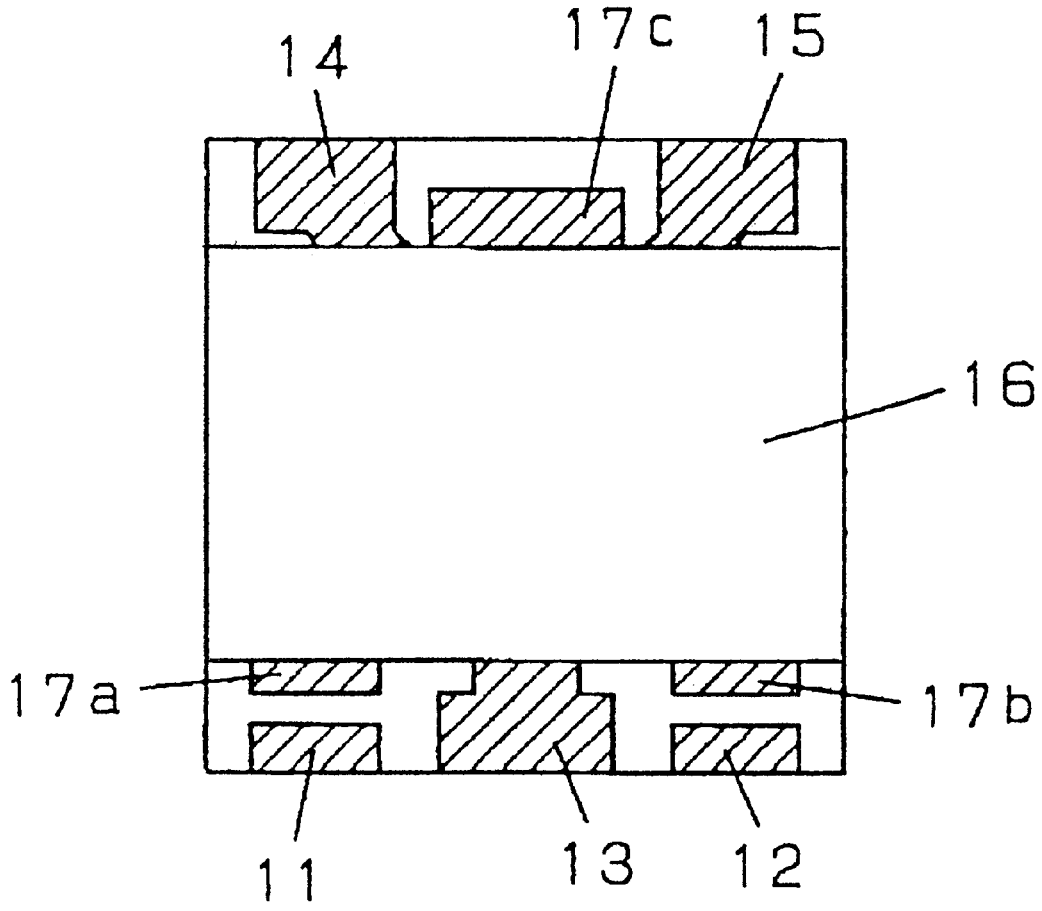
FIG. 1 is a block diagram of the isolator-mounting plane of an embodiment 1 of a first aspect of the present invention.

11, 12, 111*a*, 111*b*, 171, 172, 173 Input/output terminal
13, 14, 15, 112, 113, 114 Grounding terminal
16, 223 Lower case
17*a*, 17*b*, 17*c*, 22*a*, 22*b*, 22*c*, 30 Grounding electrode
20 Dielectric substrate
21*a*, 21*b*, 21*c*, 174, 175, 176 Capacitor
23*a*, 23*b*, 23*c* Electrode
25 Resistance
26, 211 Magnet
28, 222 Upper case
29, 110, 110' Grounding conductor
31, 32, 33, 181, 182, 183 Transmission line
34, 180, 190, 200, 201 Ferrite
35, 36 Insulting sheet
111*c* Conductor
141 Hole
150 Resin base
152*a*, 152*b*, 152*c* Grounding electrode portion for capacitor
154 Grounding electrode portion for resistance
161*a*, 161*b* Land pattern for input/output terminal
163, 164, 165, 163' Land pattern for grounding terminal
166 Element mounting portion
170 Central portion
177, 178, 179, 184, 185, 186, 221 Grounding end
191, 202, 203 Grounding electrode plane
210 Ferrite portion
220 Terminating resistance
110A, 110'A Grounding conductor
111A*a*, 111A*b*, 111'A*a*, 111'A*b*, 65A*a*, 65A*b* Input/output terminal
111A*c* Conductor
113A, 114A, 113'A, 114'A Terminal portion, Grounding terminal
21A*a*, 21A*b*, 21A*c*, 64A*a*, 64A*b*, 64A*c* Capacitor
25A, 37A, 66A Resistance
26A, 63A Magnet
27A, 68A Lower case
28A, 67A Upper case
30A Grounding electrode
31A, 32A, 33A, 61A*a*, 61A*b*, 61A*c* Strip line
34A, 62A Ferrite disk
35A, 36A Insulating sheet
1B Case lower-side
2B Dielectric substrate
3B Grounding electrode of dielectric substrate 2
4B Central conductor portion
5B Circular grounding plate
6B Dielectric layer
7B Ferrite disk
8B, 9B, 10(B) Strip line
11B, 12B Insulating sheet
13B Permanent magnet
14B Case upper-side
15B Upper side of dielectric substrate 2
16B, 17B, 18B Matching capacitor
19(B), 20B, 21B Strip-line-end connection terminal
22B, 23B External-connection input/output terminal
25B Terminating resistance
25B, 26B External-connection grounding terminal

EMBODIMENTS OF THE PRESENT INVENTION

Figure 20:
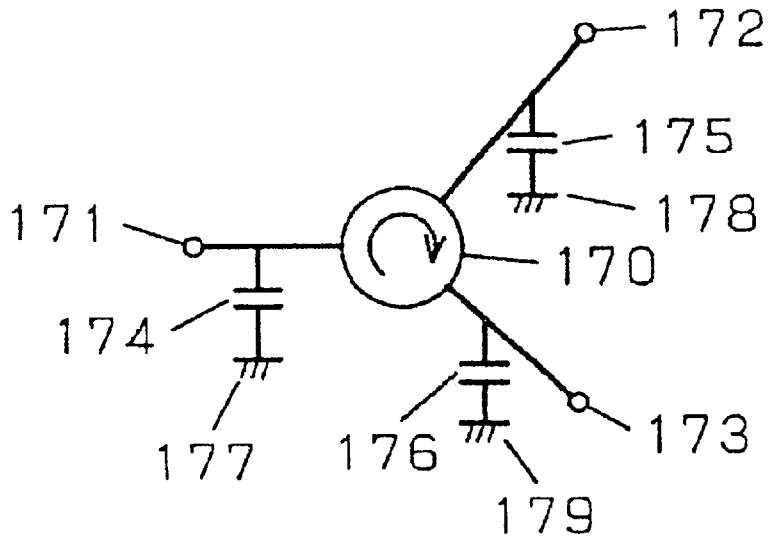
FIG. 20 is an equivalent circuit diagram of the non-reciprocal circuit element of the first aspect of the present invention.

Several typical configurations of embodiments of the first aspect of the present invention will be described below. Before describing the configurations, the basic configuration of a non-reciprocal circuit element used for the first aspect of the present invention will be described. FIG. 20 is an equivalent circuit of the non-reciprocal circuit element used for the first aspect of the present invention, in which capacitors 174, 175, and 176 are connected to input/output terminals 171, 172, and 173 in parallel and a circuit for non-reciprocally propagating a signal from 171 to 172, from 172 to 173, and from 173 to 171 is built in a central portion 170.

How to configure the central portion 170 will be described below in detail by referring to FIGS. 21 to 23.

Figure 21:
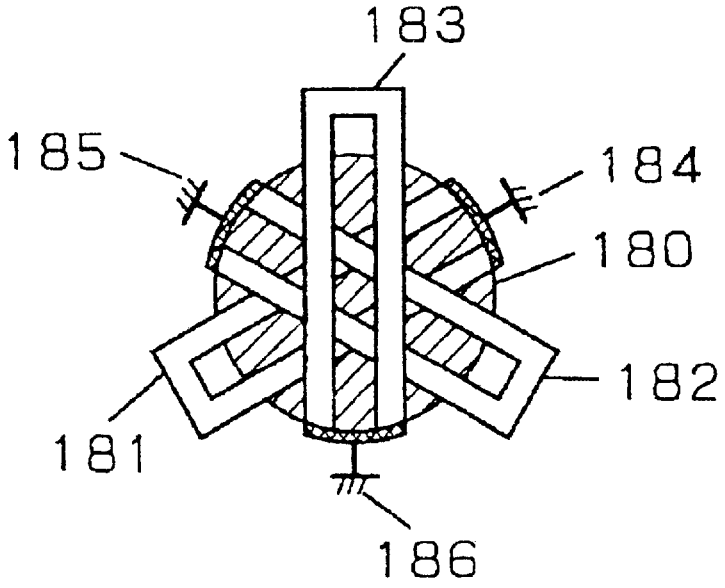
FIG. 21 is an illustration for explaining the configuration of the central portion in FIG. 20.

In FIG. 21, transmission lines 181, 182, and 183 extended from the input/output terminals 171, 172, and 173 in FIG. 20 are insulated each other on a ferrite 180 and crossed at approximately 120°. Terminations of the transmission lines 181, 182, and 183 are respectively grounded.

Figure 22:
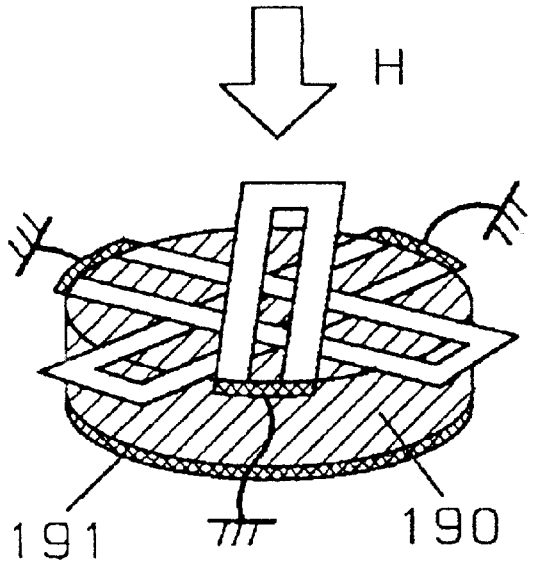
FIG. 22 is an illustration for explaining the configuration of the central portion in FIG. 20.
Figure 23:
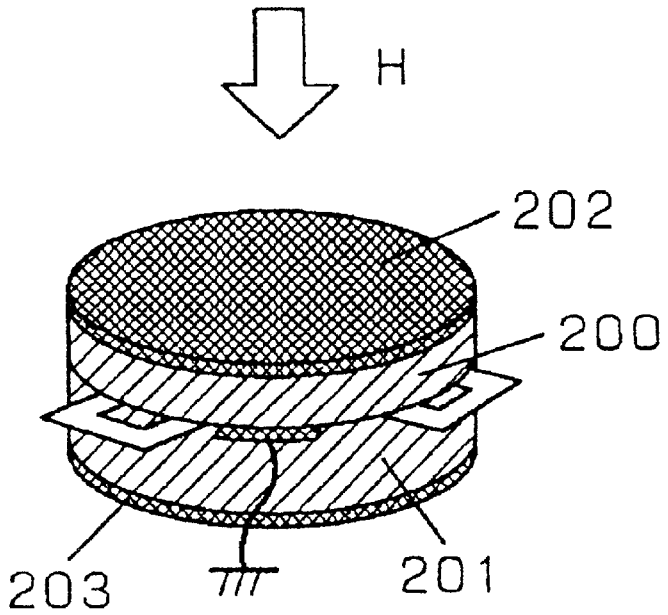
FIG. 23 is an illustration for explaining the configuration of the central portion in FIG. 20.

It is also possible to set the ferrite to either side of the crossed transmission line portion as shown in FIG. 22 or to the both sides of the portion as shown in FIG. 23. In any case, the plane of the ferrite to which the transmission line portion approaches and the faced plane of it respectively configure grounding-electrode planes 190, 202, and 203 and the ferrite is magnetized at a proper intensity determined by a circuit constant by using a permanent magnet vertically to the ferrite planes.

Figure 24:
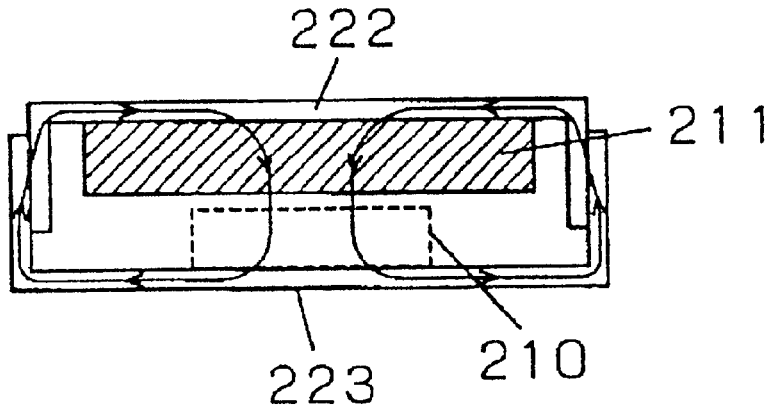
FIG. 24 is a block diagram of the magnetic circuit of the non-reciprocal circuit element of the first aspect of the present invention.

It is possible to configure a magnet for magnetizing a ferrite by only either side for the ferrite or by two magnets so as to hold the ferrite. Practically, as shown by the example in FIG. 24, a magnetic circuit is configured by arranging magnetic cases 222 and 223 serving as yokes as shown in FIG. 24.

Figure 25:
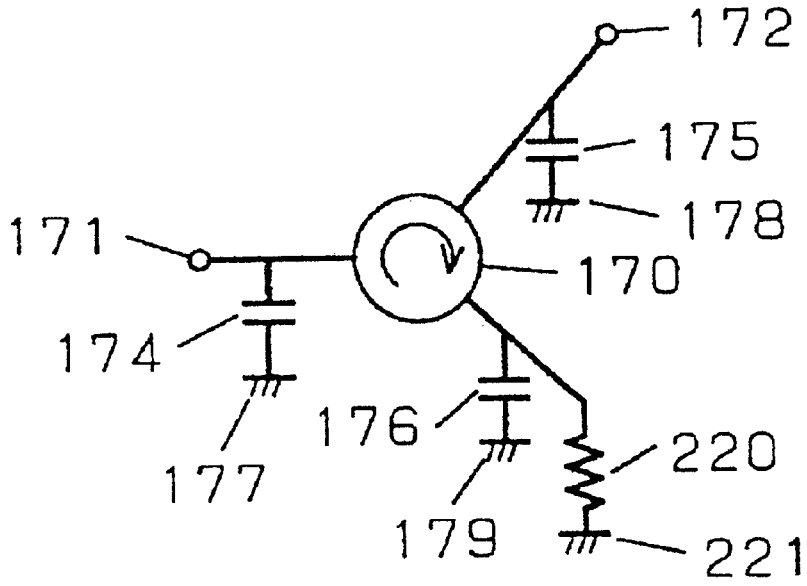
FIG. 25 is an equivalent circuit diagram when using the non-reciprocal circuit element of the first aspect of the present invention as an isolator.

By directly using the input/output end of the non-reciprocal circuit element described above, it serves as a circulator. Moreover, by terminating one input/output end by a proper resistance value as shown in FIG. 25, it serves as an isolator.

As external connection terminals, each input/output terminal and at least one external connection terminal extended from the grounding-electrode plane described in FIGS. 20 to 23 and FIG. 25 are configured on a mounting plane.

The first aspect of the present invention relates to the arrangement of the external grounding terminals. Therefore, as long as the internal configuration of a non-reciprocal circuit element is equivalent to the basic configuration described above, the circuit is effective independently of its internal configuration.

(Embodiment 1 of First Aspect of the Present Invention)

Figure 2:
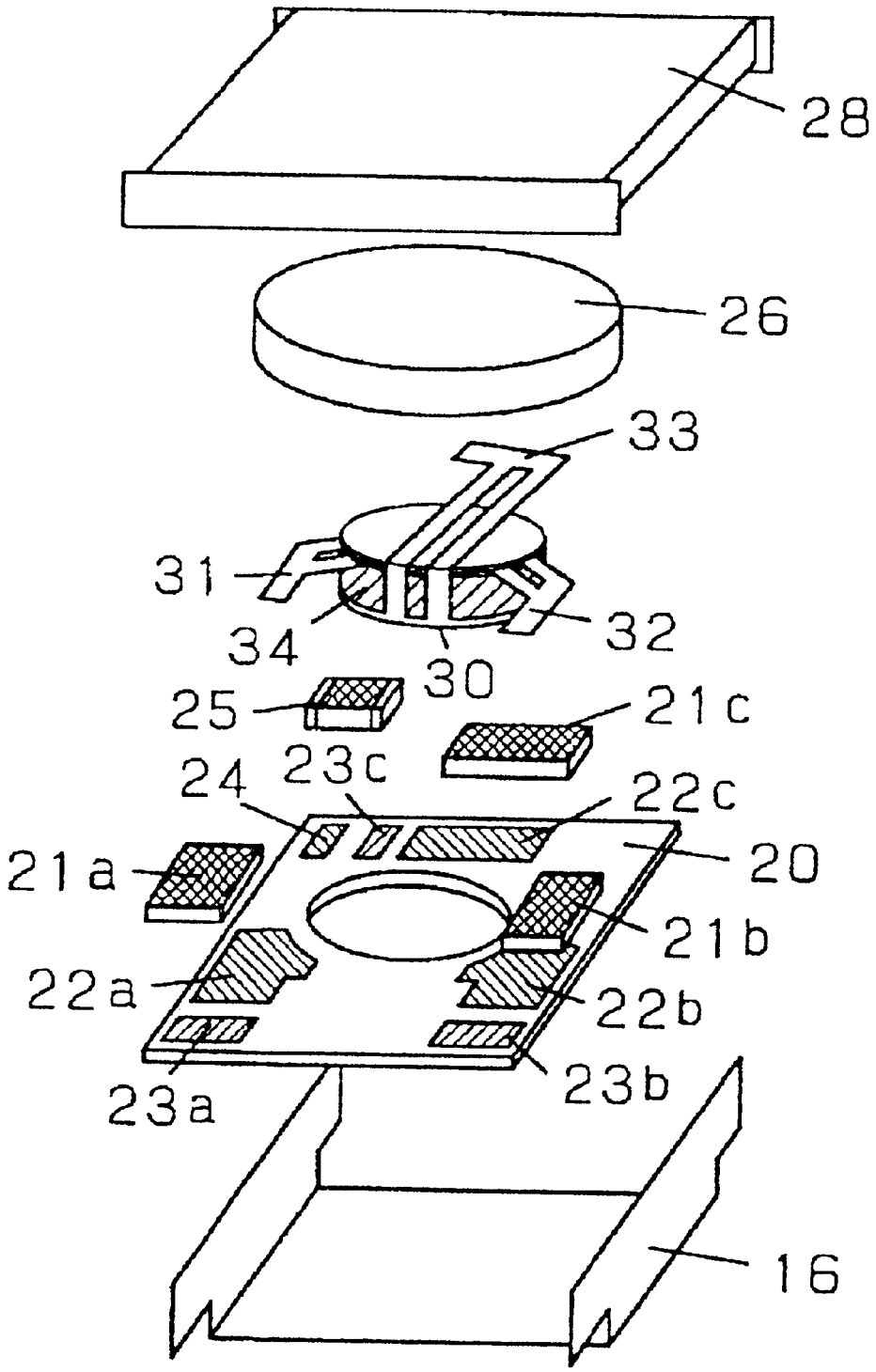
FIG. 2 is a schematic block diagram of the isolator of the embodiment 1 of the first aspect of the present invention.
Figure 3:
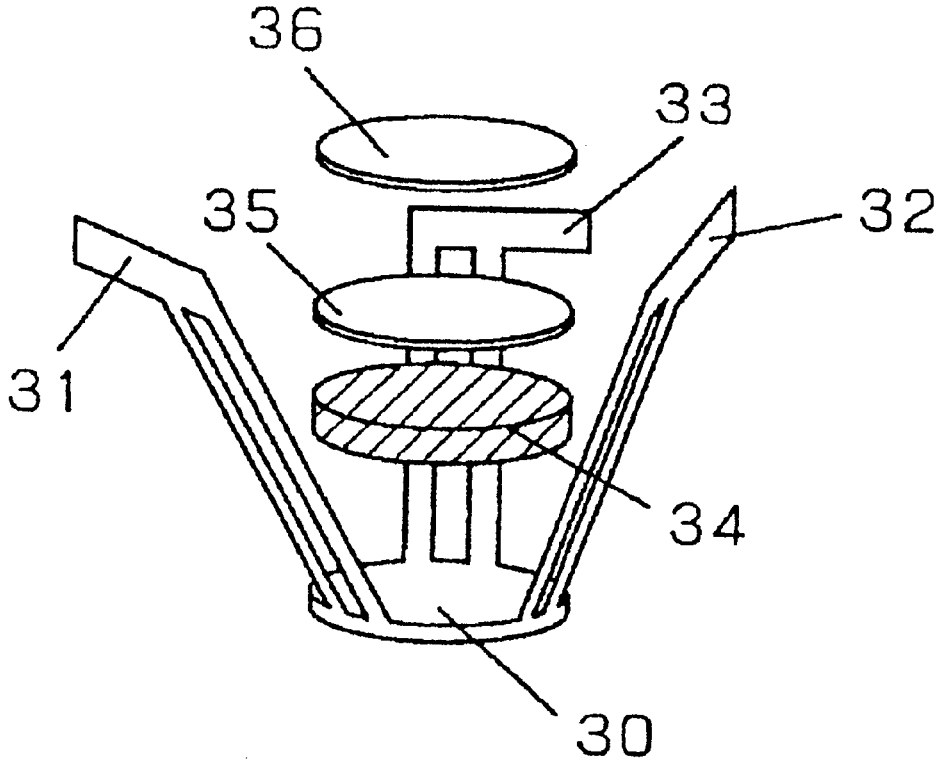
FIG. 3 is a developed block diagram of the ferrite and transmission-line portion of the isolator of the embodiment 1 of the first aspect of the present invention.

FIG. 2 shows a schematic exploded perspective view of a 940-MHz-band isolator used for the embodiment 1 of the first aspect of the present invention. FIG. 3 shows a development of the configuration of circuit means mainly configured by the ferrite and transmission line in FIG. 2. FIG. 1 is the isolator of this embodiment viewed from the mounting-plane side.

In FIG. 3, transmission lines 31, 32, and 33 to be connected to input/output terminals are connected to a common grounding electrode 30 and a discoid ferrite 34 is set onto the grounding electrode 30. Transmission lines bent toward the upper side of the ferrite 34 are crossed at approx. 120° through insulating sheets 35 and 36 and overlapped each other.

In FIG. 2, capacitors 21*a*, 21*b*, and 21*c* are arranged on grounding electrodes 22*a*, 22*b*, and 22*c* formed on a dielectric substrate 20 and ends of the transmission lines 31, 32, and 33 in FIG. 3 are connected to the electrodes (upper side) facing the grounding electrodes 22*a*, 22*b*, and 22*c*.

Moreover, ends of 31 and 32 to be connected to input/output terminals among the transmission-line ends are connected to electrodes 23*a* and 23*b* formed on the surface of the dielectric substrate 20 and the electrodes 23*a* and 23*b* are electrically connected with external input/output terminals (11 and 12 in FIG. 1) formed on the back of the dielectric substrate 20 by through-holes.

Furthermore, a terminating resistance 25 is connected to a grounding electrode 24 and an electrode 23*c* formed on the surface of the dielectric substrate 20 and the end of the transmission line 33 in FIG. 3 is also connected to the electrode 23*c*.

The grounding electrodes 22*a*, 22*b*, 22*c*, and 24 are connected to the electrodes 17*a*, 17*b*, 17*c*, and 15 in FIG. 1 by through-holes and these electrodes are electrically connected with the grounding electrode 30 in FIG. 3 through a lower case 16 made of a metallic magnetic material.

A magnet 26 and cases 16 and 28 configuring a magnetic circuit are arranged as shown in FIG. 2.

As shown in FIG. 1, the input/output terminals 11 and 12 are arranged on the mounting plane and a grounding terminal 13 which is one of external grounding terminals is set between the external input/output terminals 11 and 12.

Figure 4:
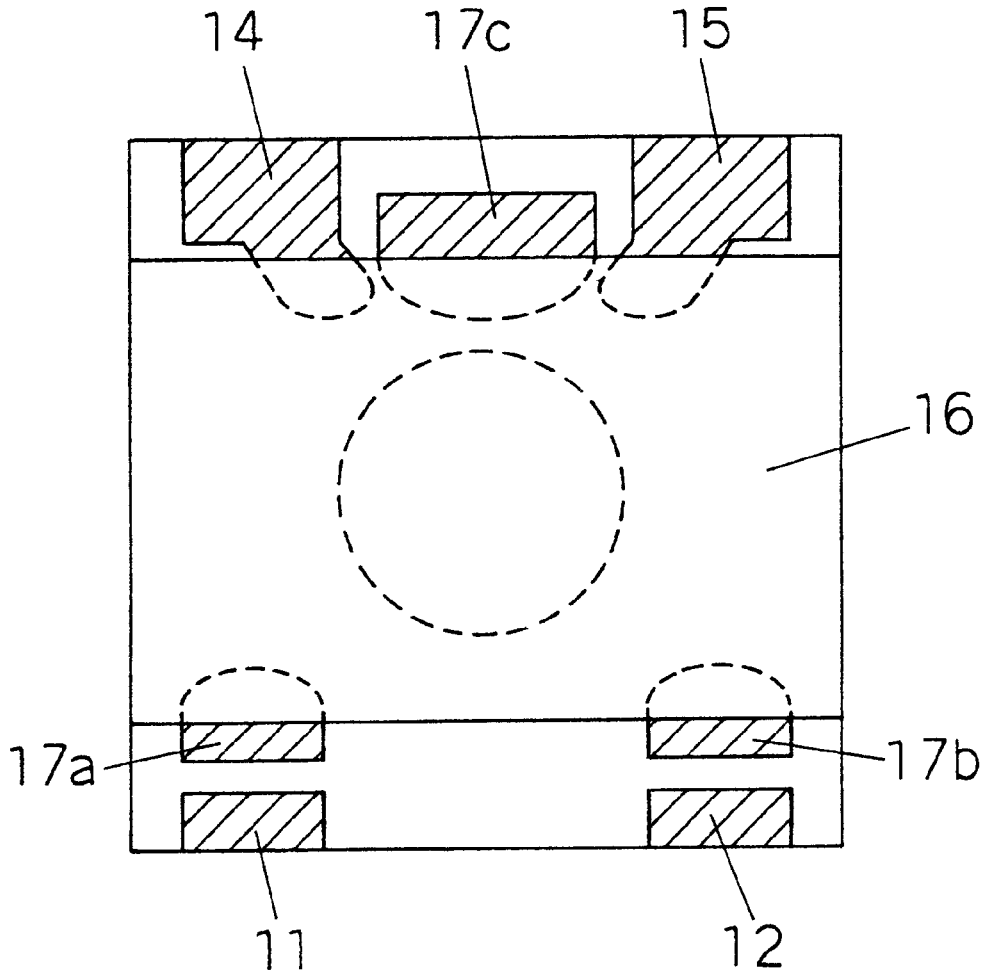
FIG. 4 is a block diagram of the isolator-mounting plane of a comparative example.

FIG. 4 shows the terminal configuration of a comparative example not provided with the grounding terminal 13.

Figure 5:
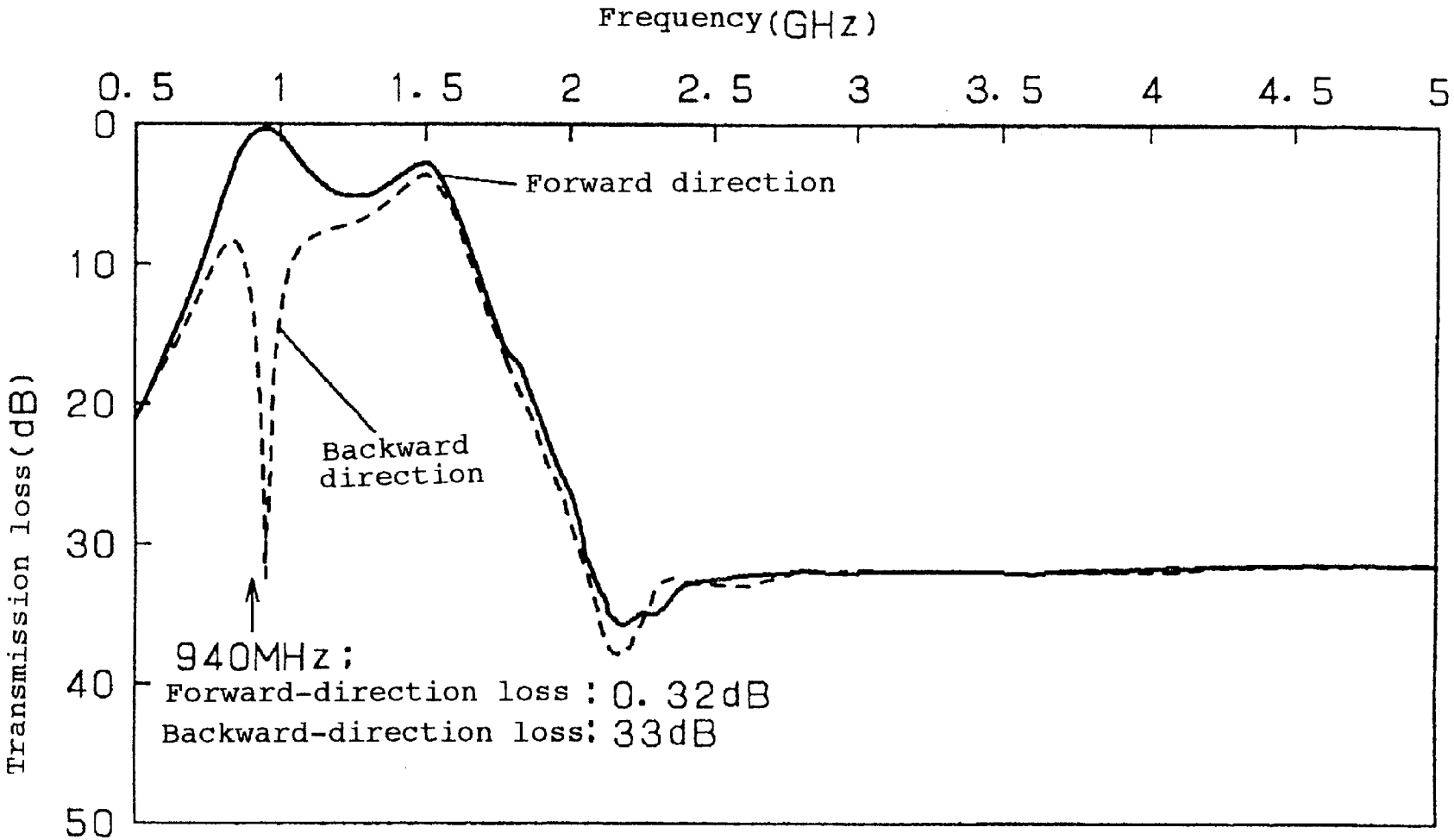
FIG. 5 is a diagram showing electrical characteristics of the isolator of the embodiment 1 of the first aspect of the present invention.
Figure 6:
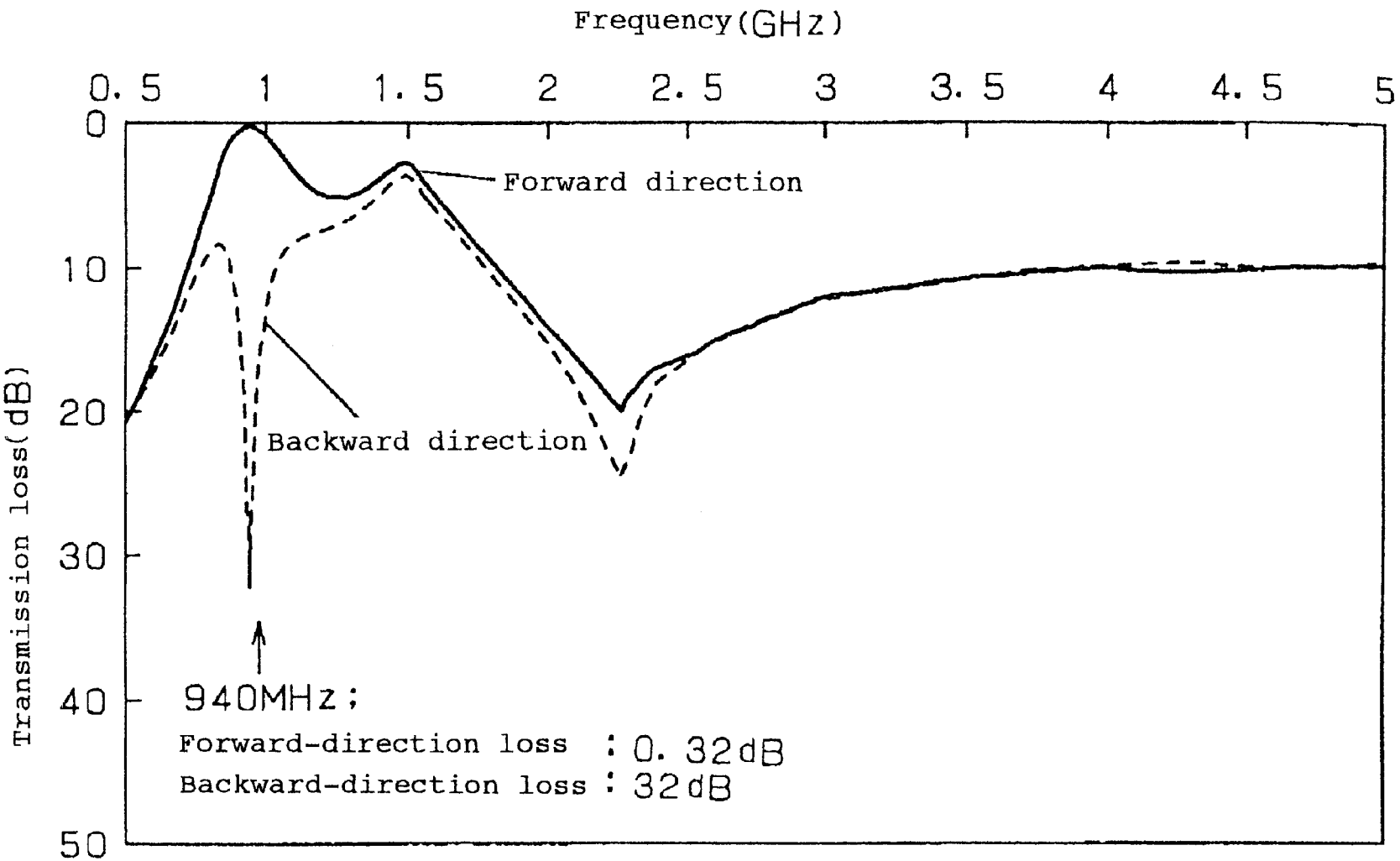
FIG. 6 is a diagram showing electrical characteristics of the isolator of a comparative example.

FIG. 5 shows electrical characteristics of the embodiment 1 and FIG. 6 shows electrical characteristics of the comparative example in FIG. 4. From FIGS. 5 and 6, it is found that a high attenuation of 30 dB or more is obtained in a high-frequency region without deteriorating isolator characteristics in the case of this embodiment. This is probably because the grounding terminal 13 is set between the external input/output terminals 11 and 12 and thereby, the electromagnetic shielding effect is displayed and noises are reduced.

When a plurality of external grounding terminals 13, 14, and 15 are present like the case of this embodiment, the grounding terminals 14 and 15 not present between the external input/output terminals 11 and 12 are arranged at the opposite side to the grounding terminal 13 present between the terminals 11 and 12 on the basis of the dielectric substrate 20 as shown in FIG. 1. As described above, by arranging external grounding terminals on the entire non-reciprocal circuit element at a good balance, a wiring extended from a capacitor or the like is shortened and it is estimated that superior isolator characteristics shown in FIG. 5 are obtained.

In the case of this embodiment, it is preferable that the surface of a lower case is covered with a layer mainly containing Ag or Au superior in electric conductivity.

(Embodiment 2 of First Aspect of the Present Invention)

Figure 7:
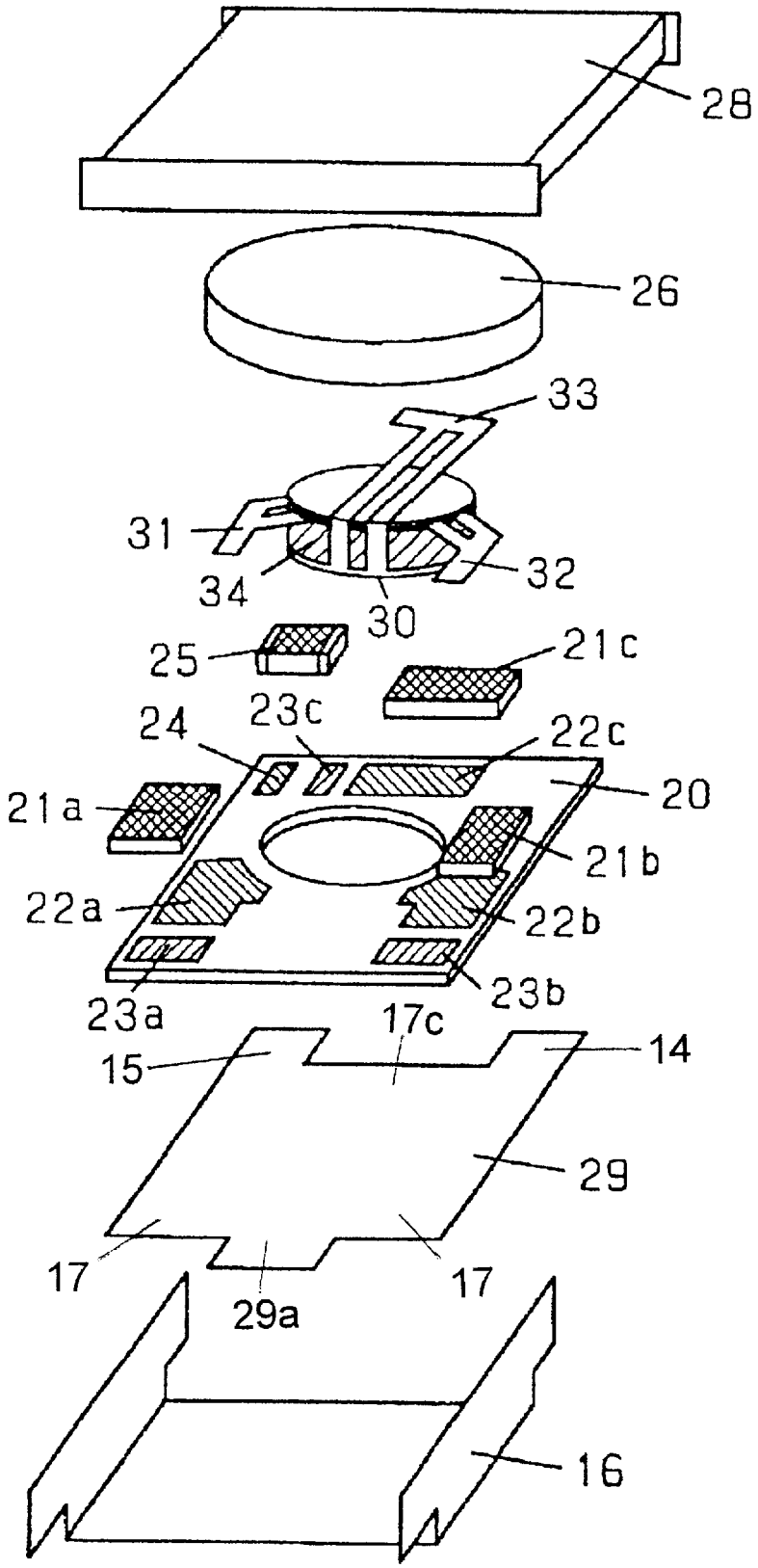
FIG. 7 is a schematic block diagram of the isolator of an embodiment 2 of the first aspect of the present invention.
Figure 8:
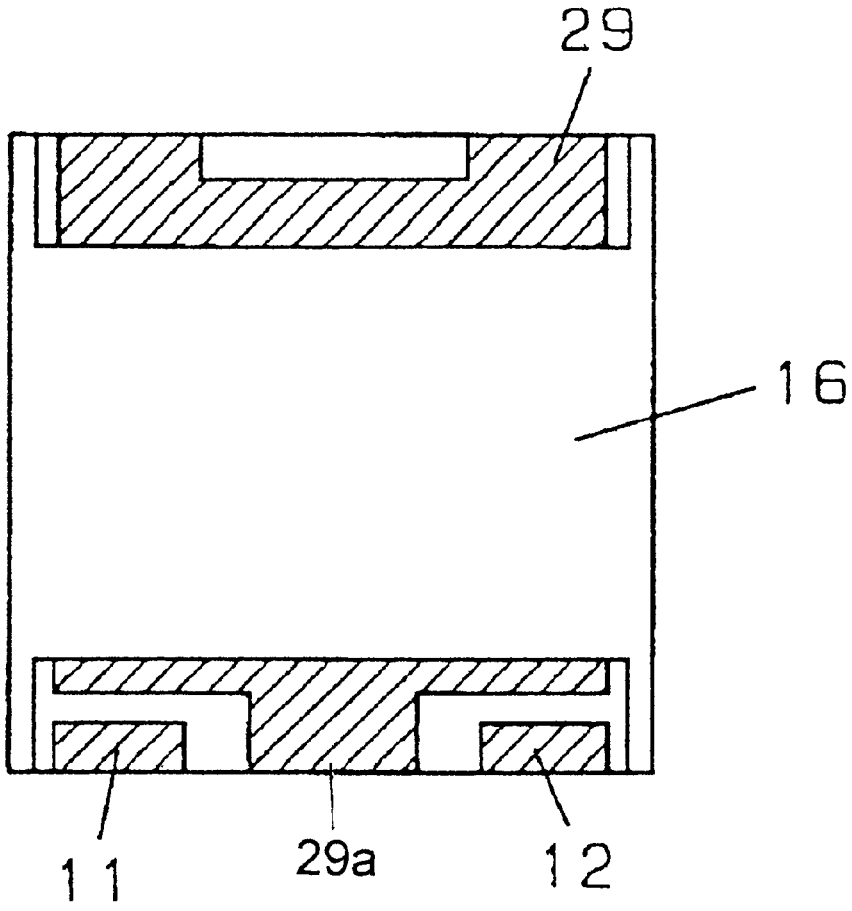
FIG. 8 is a block diagram of the isolator-mounting plane of the embodiment 2 of the first aspect of the present invention.

FIG. 7 shows a schematic block diagram of a 940-MHz-band isolator used for the embodiment 2. The configuration of a ferrite and a transmission-line portion are the same as FIG. 3 of the embodiment 1. FIG. 8 is the isolator of this embodiment viewed from the mounting-plane side.

In FIG. 7, capacitors 21*a*, 21*b*, and 21*c* are arranged on grounding electrodes 22*a*, 22*b*, and 22*c* formed on a dielectric substrate 20 and ends of the transmission lines 31, 32, and 33 in FIG. 3 are connected to the electrodes facing the electrodes 22*a*, 22*b*, and 22*c*.

Moreover, ends of 31 and 32 to be connected to input/output terminals among the transmission-line ends are also connected to electrodes 23*a* and 23*b* electrically connected with external connection terminals (11 and 12 in FIG. 8) on the back of the dielectric substrate 20 by through-holes. Furthermore, a terminating resistance 25 is connected to the grounding electrode 24 and the electrode 23*c* and the end of the transmission line 33 in FIG. 3 is connected also to the electrode 23*c*.

The grounding electrodes 22*a*, 22*b*, 22*c*, and 24 are connected to electrodes arranged on the back by through-holes and the electrodes and the grounding electrode 30 in FIG. 3 are electrically connected each other through a grounding conductor 29.

The magnet 26 and cases 16 and 28 configuring a magnetic circuit are arranged as shown in FIG. 7.

Moreover, the input/output terminals 11 and 12 are arranged on the back of the dielectric substrate 20 as shown in FIG. 8 and a part 29*a* of the grounding conductor 29 is set between the input/output terminals 11 and 12 as illustrated.

Figure 9:
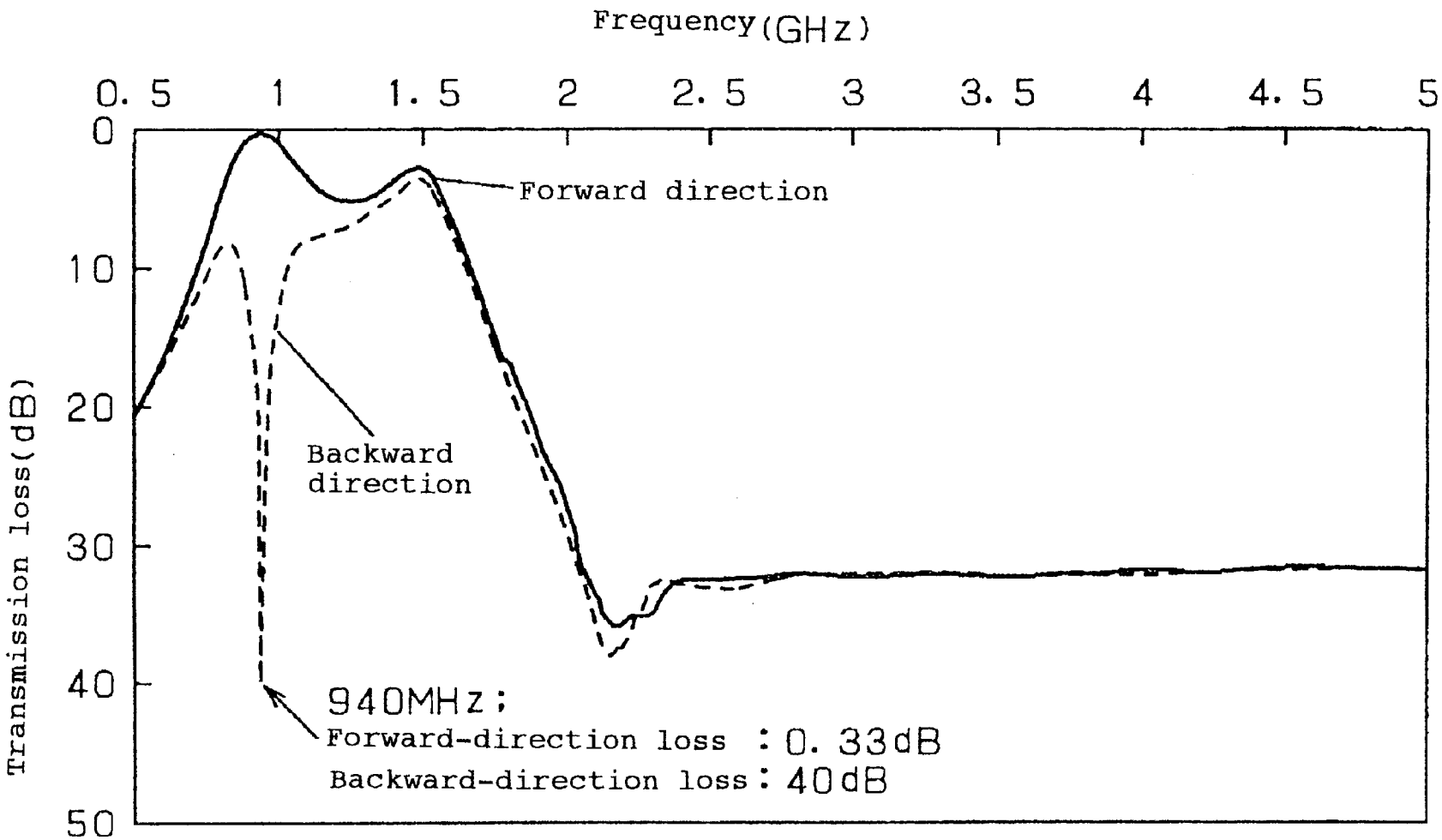
FIG. 9 is a diagram showing electrical characteristics of the isolator of the embodiment 2 of the first aspect of the present invention.

FIG. 9 shows electrical characteristics of the embodiment 2. From FIG. 9, it is found that a high attenuation of 30 dB or more is obtained without deteriorating isolator characteristics in case of this embodiment.

Figure 10A:
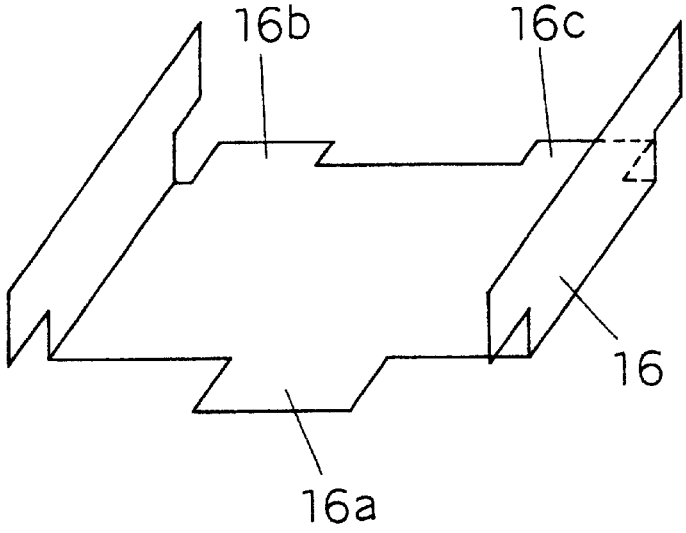
FIGS. 10(A) and 10(B) are block diagrams of the lower case of the embodiment 2 of the first aspect of the present invention.

Moreover, by forming a part 16*a* on the lower case 16 as shown in FIG. 10(A), it is possible to serve as the grounding conductor 29*a* in FIG. 7 or the external grounding terminal 13 in FIG. 1.

Figure 10B:
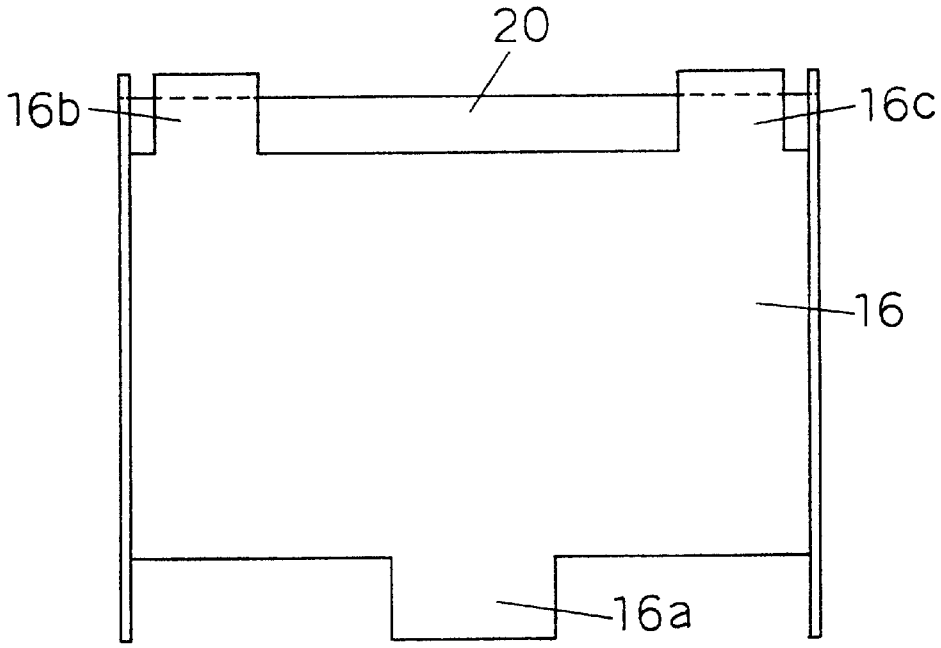

Furthermore, it is possible to form parts 16*b* and 16*c* on the lower case 16 as shown in FIGS. 10(A) and 10(B). The parts 16*b* and 16*c* are overlapped with the external grounding terminals 14 and 15 in FIG. 1 and moreover, protrude beyond the dielectric substrate 20. Thereby the grounding effect is further improved.

Furthermore, it is preferable that the surface of the lower case 16 is covered with a layer mainly containing Ag or Au superior in electric conductivity.

(Embodiment 3 of First Aspect of the Present Invention)

Figure 11:
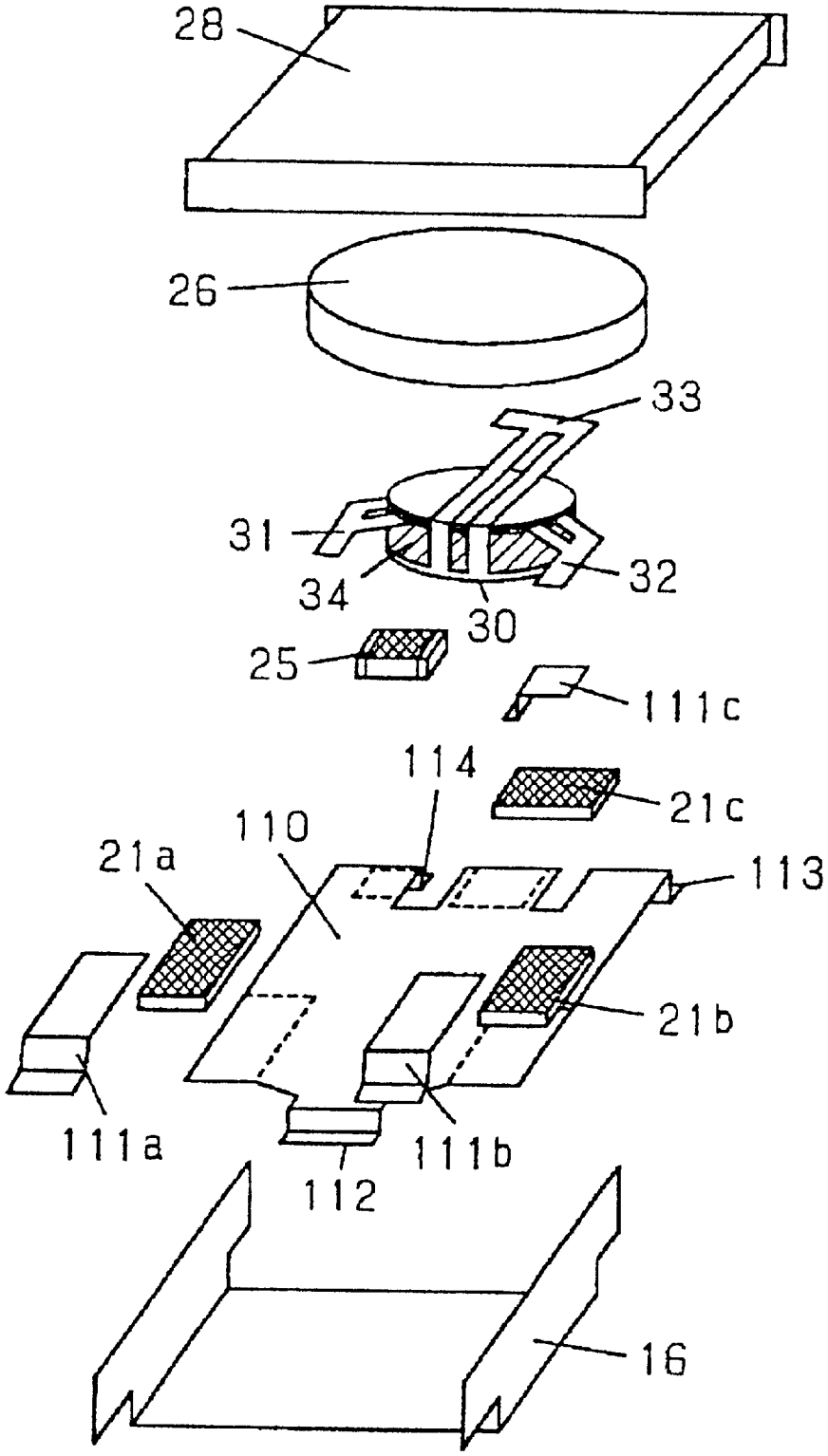
FIG. 11 is a schematic block diagram of the isolator of the embodiment 3 of the first aspect of the present invention.
Figure 12:
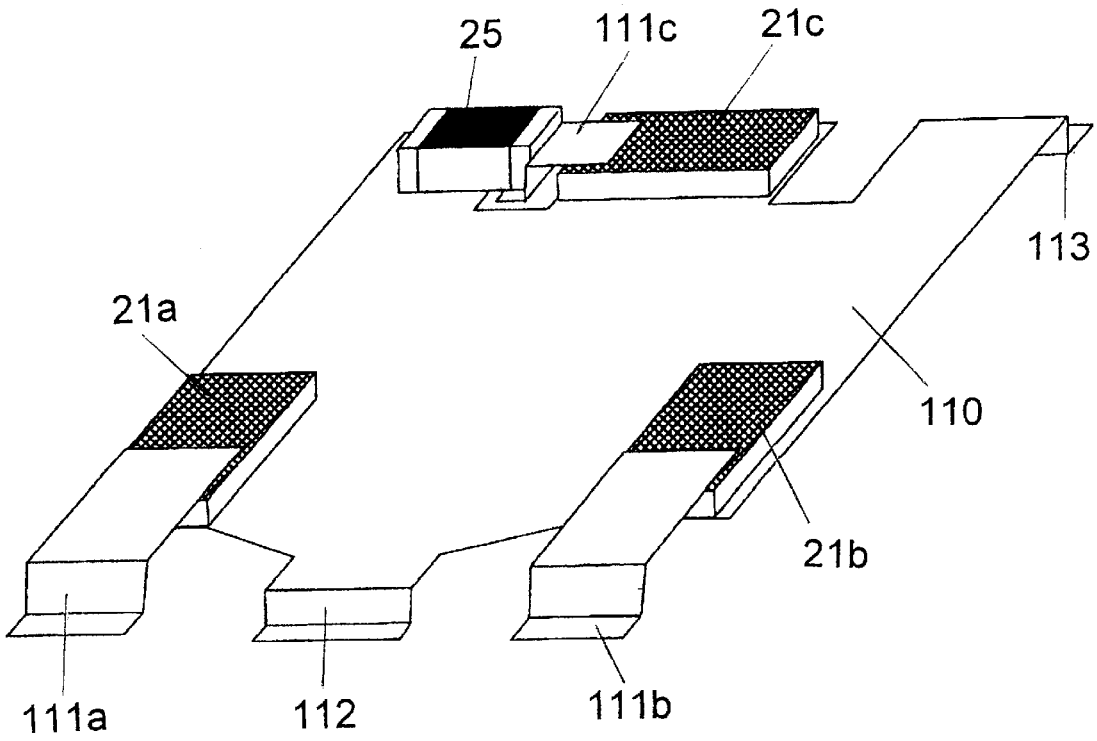
FIG. 12 is a schematic assembly diagram of the isolator of embodiment 3 of the first aspect of the present invention.
Figure 13:
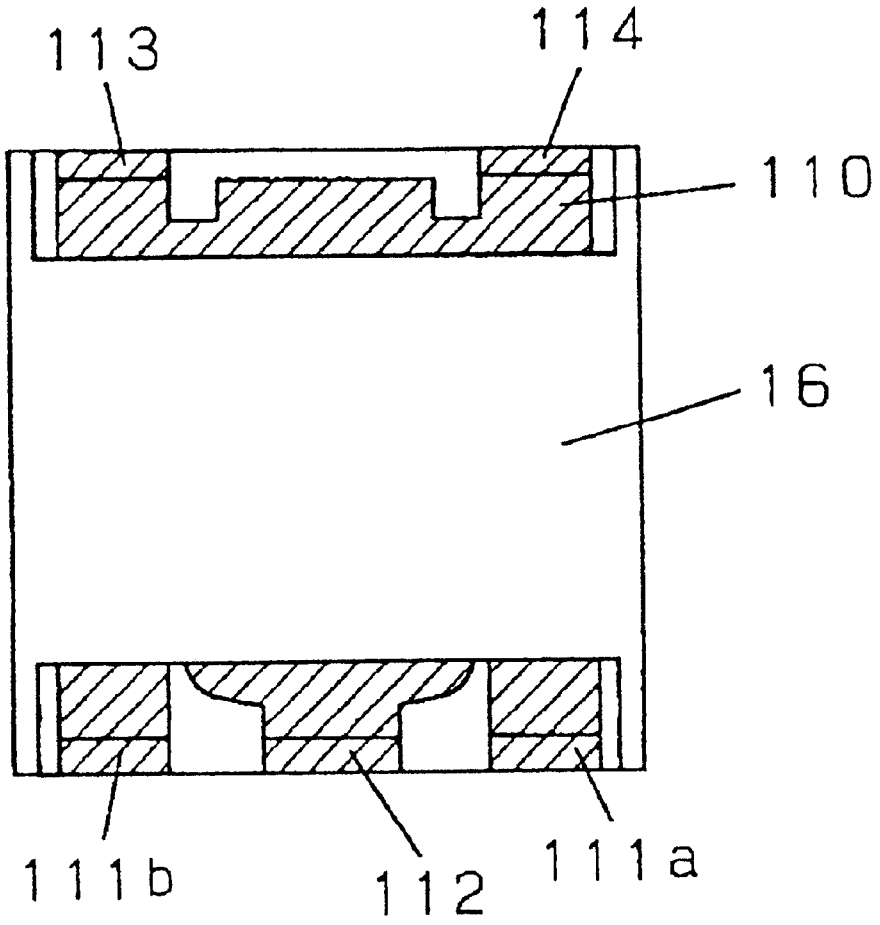
FIG. 13 is a block diagram of the isolator-mounting plane of the embodiment 3 of the first aspect of the present invention.

FIG. 11 shows a schematic configuration of a 940-MHz-band isolator used for the embodiment 3. The configuration of the central conductor portion is the same as that of the embodiment 1 in FIG. 3. FIG. 13 shows the isolator of this embodiment viewed from the mounting-plane side. FIG. 12 is a perspective view showing the assembled isolator. In FIG. 11, capacitors 21*a*, 21*b*, and 21*c* are arranged on an integrated grounding conductor 110 having no discontinuous portion and ends of the transmission lines 31, 32, and 33 in FIG. 3 are connected to the electrodes facing the capacitors 21*a*, 21*b*, and 21*c*.

Moreover, a conductor 111*c* is connected which is extended to external input/output terminals 111*a* and 111*b* and moreover the electrode of either side of a terminating resistance 25 from the faced electrodes.

The grounding-side electrode of the terminating resistance 25 is connected to the grounding conductor 110. The grounding electrode 30 in FIG. 3 is also connected to the grounding conductor 110. The grounding conductor 110 has terminals 112, 113, and 114 and is used as an external grounding terminal.

The magnets 26 and cases 16 and 28 configuring a magnetic circuit are arranged as shown in FIG. 11.

Moreover, an external grounding terminal 112 is set between the external input/output terminals 111*a* and 111*b* as shown in FIG. 13.

Figure 14:
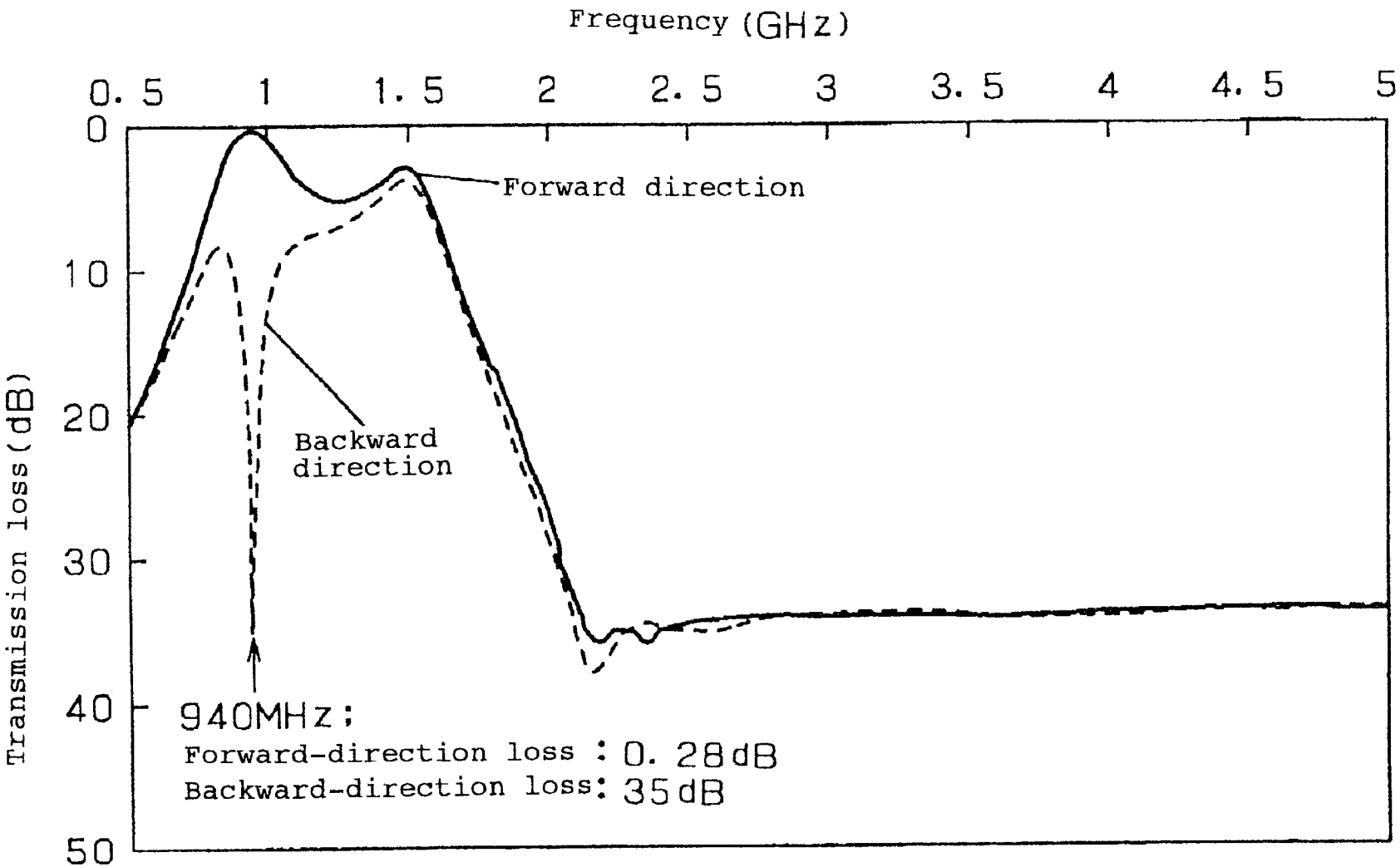
FIG. 14 is a diagram showing electrical characteristics of the isolator of the embodiment 3 of the first aspect of the present invention.

FIG. 14 shows electrical characteristics of the embodiment 3. From FIG. 14, it is found that a high attenuation close to 35 dB is obtained in a high-frequency region without deteriorating isolator characteristics in the case of this embodiment. Moreover, by using an integrated grounding conductor having no discontinuous portion, the forward-directional loss is greatly improved among original isolator characteristics compared to the cases of the embodiments 1 and 2.

Figure 15:
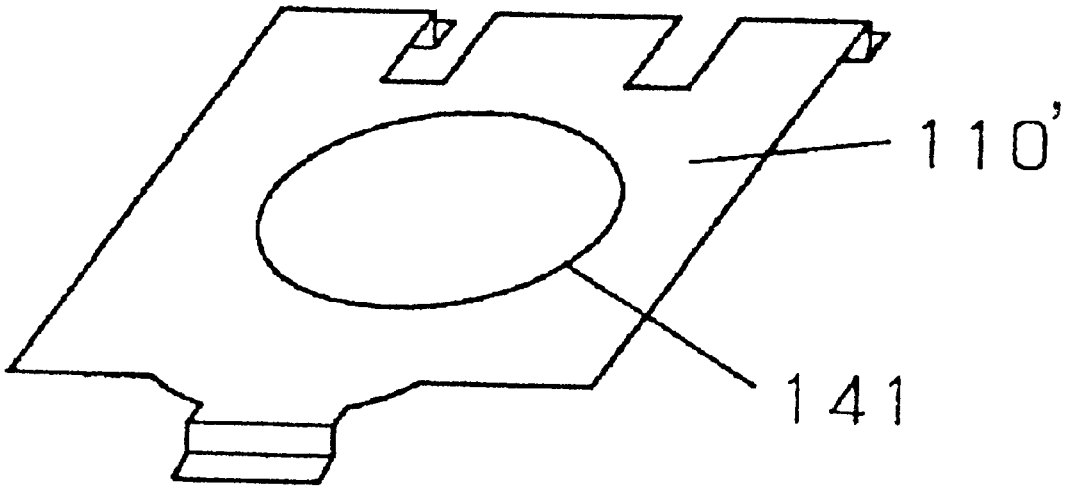
FIG. 15 is a block diagram of a hole-provided grounding conductor of the embodiment 3 of the first aspect of the present invention.

Moreover, by forming a hole 141 shown in FIG. 15 at the central portion of the grounding conductor 110', directly connecting the grounding electrode of a central-conductor portion to the lower case 16, and moreover electrically connecting the grounding electrode with the grounding conductor through the lower case 16, it is possible to decrease the height of the element.

In this case, it is preferable that the surface of the lower case 16 is covered with a layer mainly containing Ag or Au superior in electric conductivity.

Figure 16:
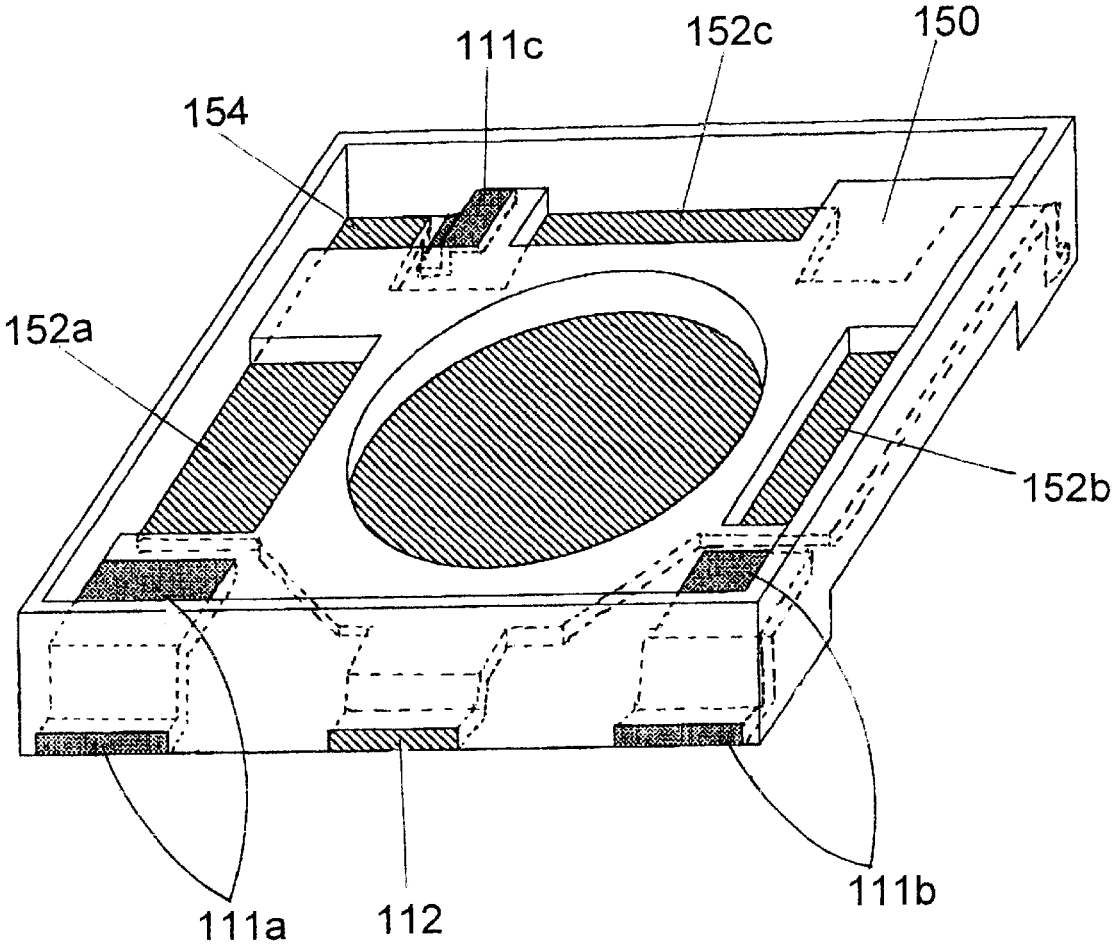
FIG. 16 is a block diagram of the resin base of the embodiment 3 of the first aspect of the present invention.
Figure 17:
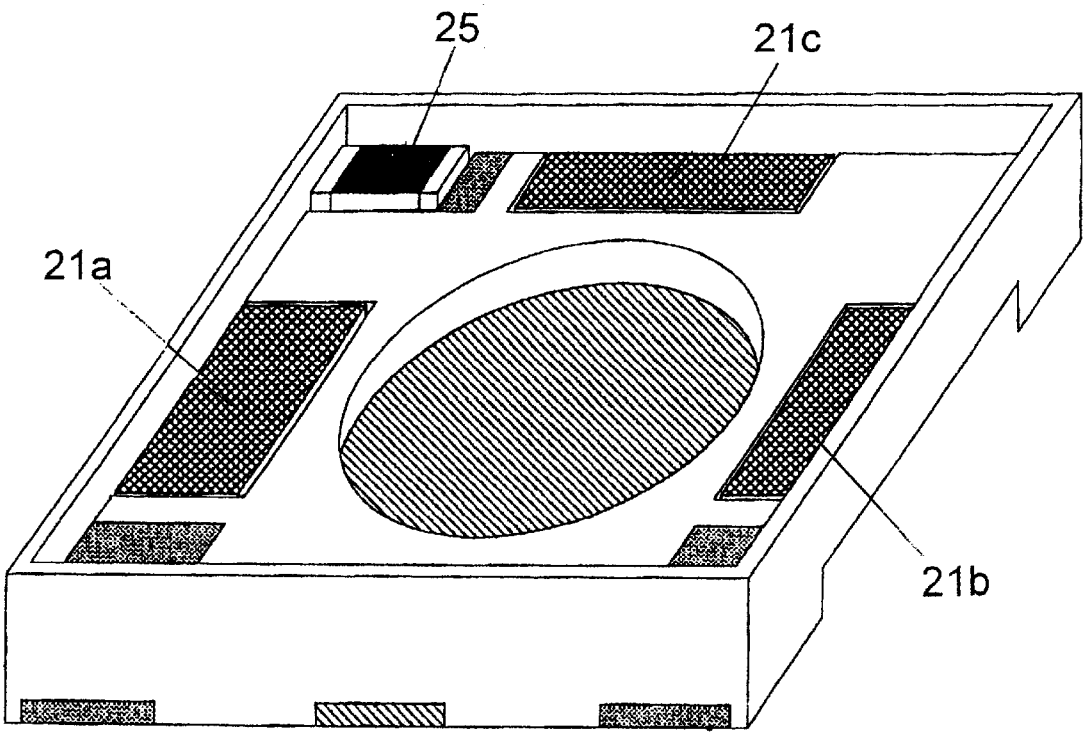
FIG. 17 is a block diagram of the resin base of the embodiment 3 of the first aspect of the present invention.
Figure 18:
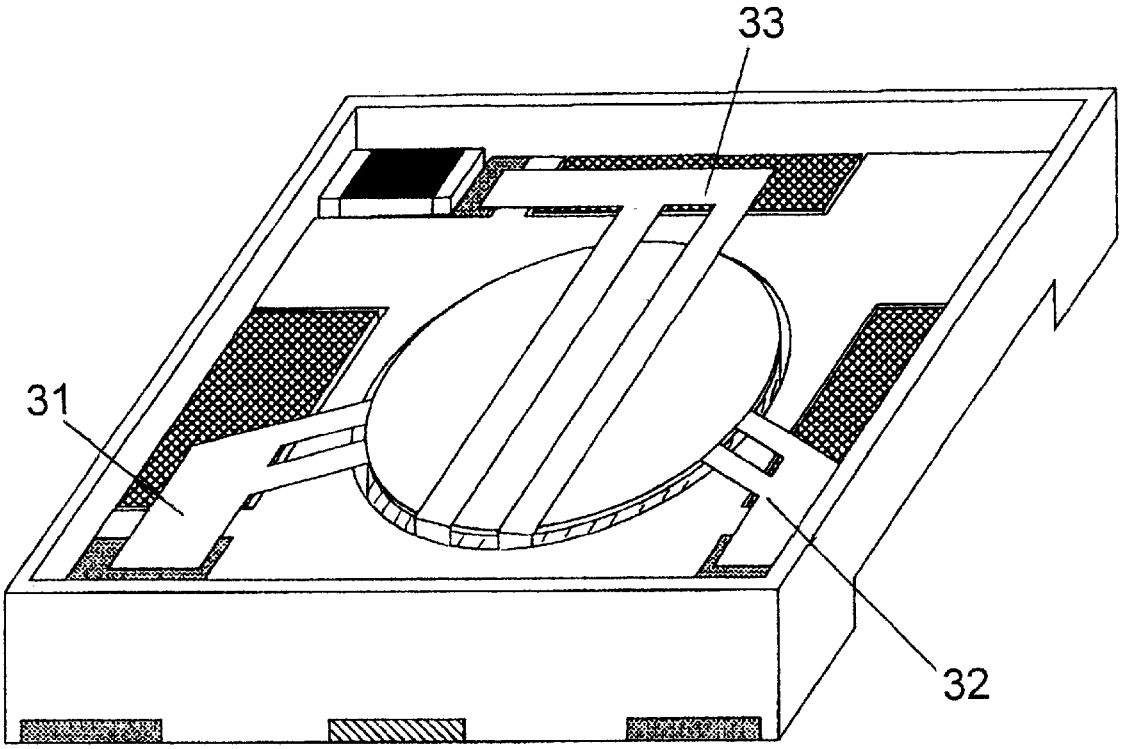
FIG. 18 is a block diagram of the resin base of the embodiment 3 of the first aspect of the present invention.

Moreover, as shown in FIG. 16, by molding the input/output terminals 111*a* and 111*b* in FIG. 11 and the conductor 111*c* and grounding conductor 110 with resin and integrating them, the configuration of the entire element is simplified and the productivity is greatly improved. FIG. 17 is a perspective view of the element into which the capacitor 21 and resistance 25 are incorporated and FIG. 18 is a perspective view of the element into which the ferrite 34 and transmission lines 31, 32 and 33 are further incorporated.

The embodiments 1 to 3 are described in accordance with the configuration of an isolator. By removing the terminating resistance 25 and taking out a terminal connected with the terminating resistance 25 as an external input/output terminal, the terminal can be used as a circulator. In this case, between the input/output terminals provided with a terminal for grounding, which is at least a configuration of the first aspect of the present invention a high attenuation is obtained in a high-frequency region without deteriorating the transmission characteristic in the original band.

Moreover, the embodiments 1 to 3 are described by using the 940-MHz frequency band widely used for transmission stages of domestic portable-telephone terminals at present as an example. However, the first aspect of the present invention is not restricted to the above frequency band. The first aspect is also effective for a non-reciprocal circuit element designed for a 1.5- or 1.9-GHz band.

(Embodiment 4 of First Aspect of the Present Invention)

As for the embodiment 4, the configuration of a mounting substrate is described which is required when using a non-reciprocal circuit element of the first aspect of the present invention described till the embodiment 3 for the terminal of a portable telephone or the like.

Figure 19A:
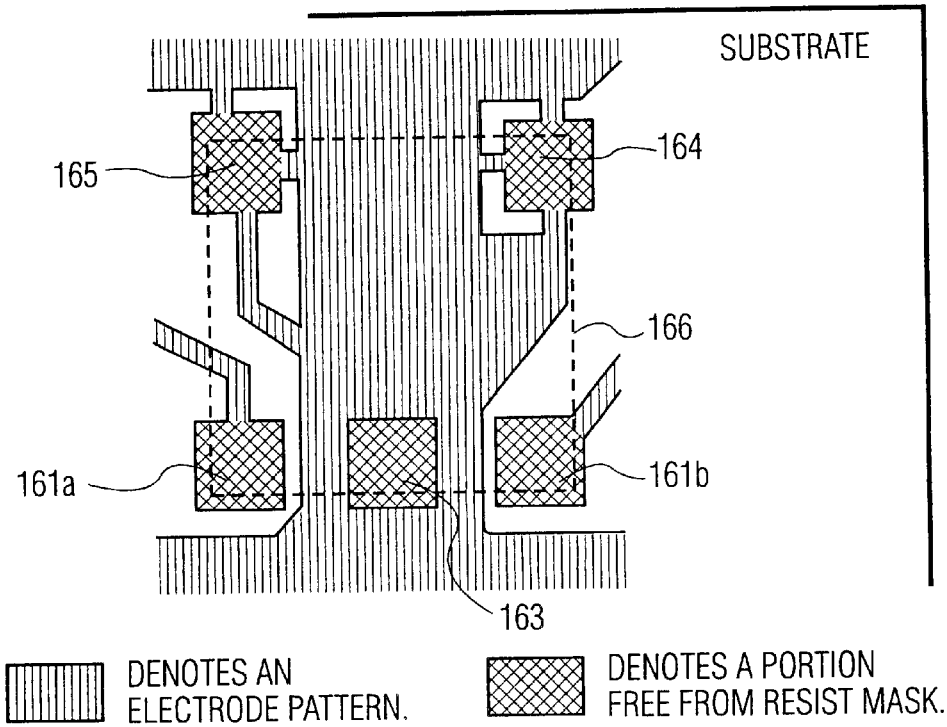
FIGS. 19(A) and 19(B) are illustrations showing electrode patterns of the mounting substrate of embodiment 4 of the first aspect of the present invention.

As shown in FIG. 19(A), a land pattern 163 to which an external grounding terminal or a grounding conductor is connected is set between land patterns 161*a* and 161*b* to which external input/output terminals are connected as a land pattern on which the non-reciprocal circuit element is mounted.

Figure 19B:
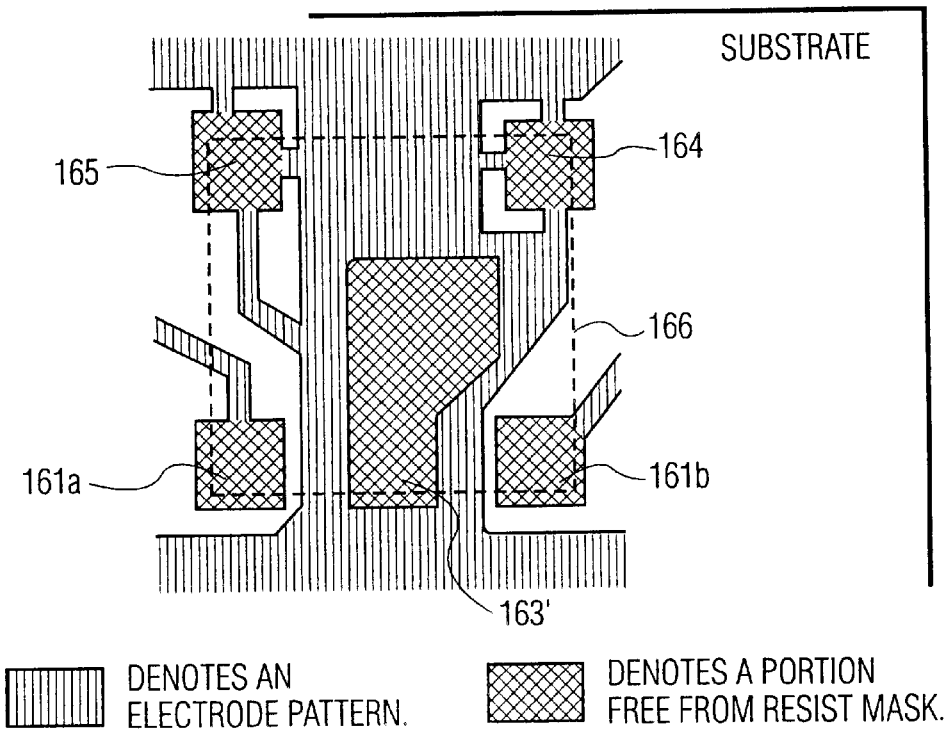

A land pattern to which the grounding conductor is connected is not restricted to FIG. 19(A). It is also permitted to configure a land pattern like the land pattern 163' in FIG. 19(B) so that apart of the pattern 163' is present between the input/output-terminal land patterns 161*a* and 161*b*.

Because a non-reciprocal circuit element of the first aspect of the present invention is used by being mounted on the substrate shown in this embodiment, when the circuit element is used for the terminal unit of a portable telephone, the circuit element can be used as a non-reciprocal circuit element provided with the LPF function. Therefore, an LPF having been used for the transmission stage so far is unnecessary and it is possible to contribute to downsizing of a substrate and in its turn, contribute to downsizing of a terminal unit.

As described above, the first aspect of the present invention makes it possible to obtain a non-reciprocal circuit element having a large attenuation in a high-frequency region without deteriorating the conventional transmission characteristic.

Moreover, by mounting a non-reciprocal circuit element of the first aspect of the present invention on a substrate of the first aspect of the present invention, it is possible to use the circuit element as a non-reciprocal circuit element provided with the LPF function and omit a conventional LPF.

Then, embodiments of the second aspect of the present invention will be described below by referring to the accompanying drawings.

(Embodiment 1 of Second Aspect of the Present Invention)

Figure 26:
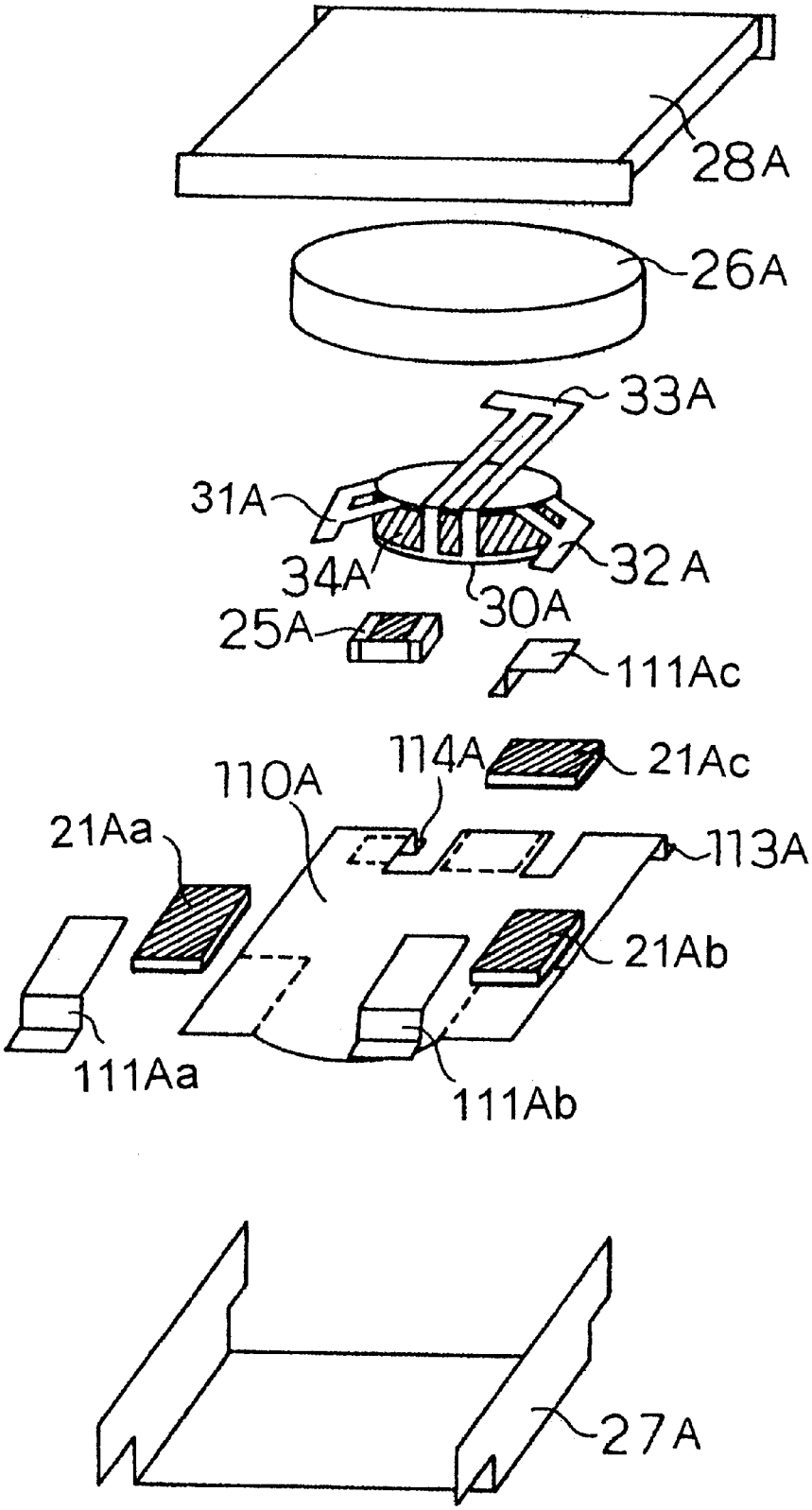
FIG. 26 is a schematic block diagram of the lumped element type isolator of embodiment 1 of the second aspect of the present invention.
Figure 27:
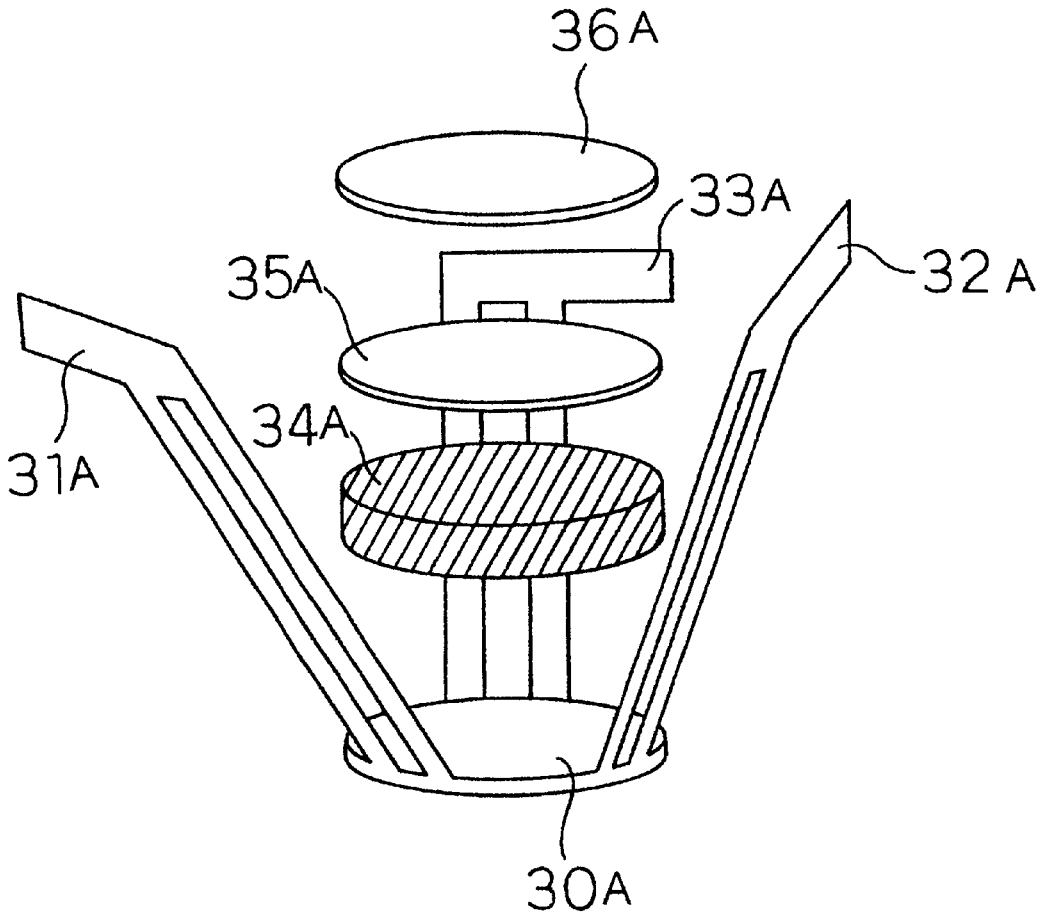
FIG. 27 is a developed block diagram of the ferrite disk and transmission-line portion of the lumped element type isolator of the embodiment 1 of the second aspect of the present invention.

FIG. 26 shows a schematic block diagram of the lumped element type isolator of the embodiment 1 of the second aspect of the present invention. FIG. 27 shows a development of the configuration of the ferrite disk 34A and transmission-line portion in FIG. 26. For the embodiment 1, a case of transmitting a 940-MHz-band signal is described to simplify the description.

In FIG. 27, strip lines 31A, 32A, and 33A to be connected to the input/output terminals 111A*a* and 111A*b* or the conductor 111A*c* in FIG. 26 are connected to a common grounding electrode 30A and a discoid ferrite 34A is set on the grounding electrode 30A. The strip lines 31A, 32A, and 33A bent to the upper side of the ferrite disk 34A are crossed at 120° and overlapped through insulating sheets 35A and 36A.

In FIG. 26, capacitors 21A*a*, 21A*b*, and 21A*c* are arranged on a grounding conductor 110A and ends of the strip lines 31A, 32A, and 33A in FIG. 27 are connected to the electrodes facing the capacitors. Moreover, the end of the strip line 31A is connected with the input/output terminal 111A*a*, the end of the strip line 32A is connected with the input/output terminal 111A*b*, and the end of the strip line 33A is connected with the conductor 111A*c*, and one electrode of the resistance 25A is connected with the conductor 111A*c* and the other electrode of the resistance 25A is connected with the grounding conductor 110A.

Moreover, the grounding electrode 30A in FIG. 26 is also connected to the grounding conductor 110A. The grounding conductor 110A has terminal portions 113A and 114A and is used as an external-connection grounding terminal. A magnet 26A for magnetizing the ferrite disk 34A is set on the strip lines 31A, 32A, and 33A so as to face the ferrite disk 34A.

Furthermore, an upper case 28A and lower case 27A for storing the ferrite disk 34A, strip lines 31A, 32A, and 33A, resistance 25A, magnet 26A, and grounding conductor 110A are arranged as shown in FIG. 26. The upper case 28A and lower case 27A serve as a part of a magnetic circuit as described in "Related Art of the Invention".

Furthermore, the upper case 28A and lower case 27A have an opening in the length-axis direction of the strip line 33A to which the resistance 25 is connected through the conductor 111A on the ferrite disk 34A as a whole. In other words, the upper case 28A and lower case 27A have a cylindrical shape having an opening in the length-axis direction of the strip line 33A on the ferrite disk 34A as a whole. Furthermore, the lower case 27A is electrically connected with the grounding conductor 110A.

Figure 28:
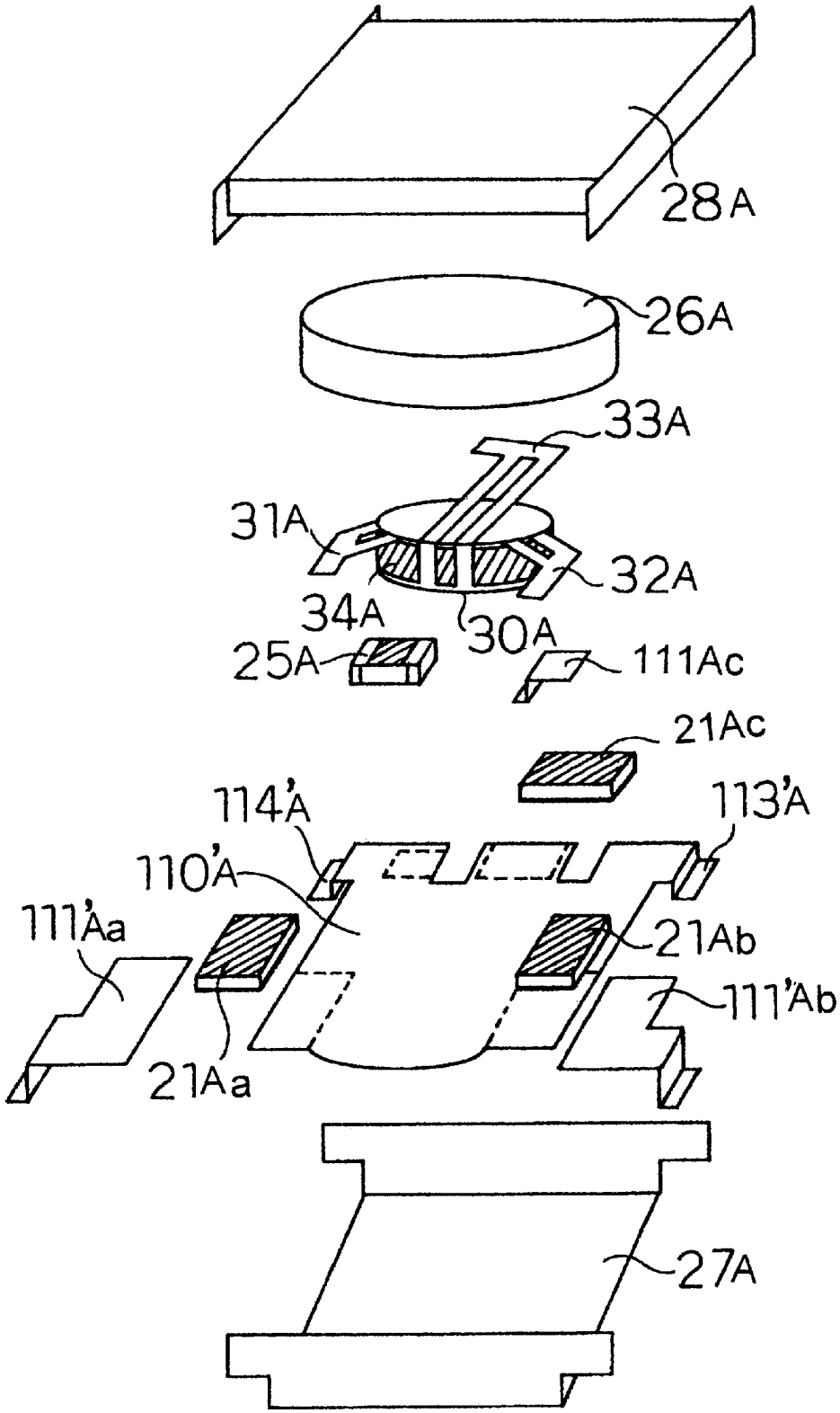
FIG. 28 is a schematic block diagram of the lumped element type isolator of a comparative example of the embodiment 1 of the second aspect of the present invention.
Figure 31:
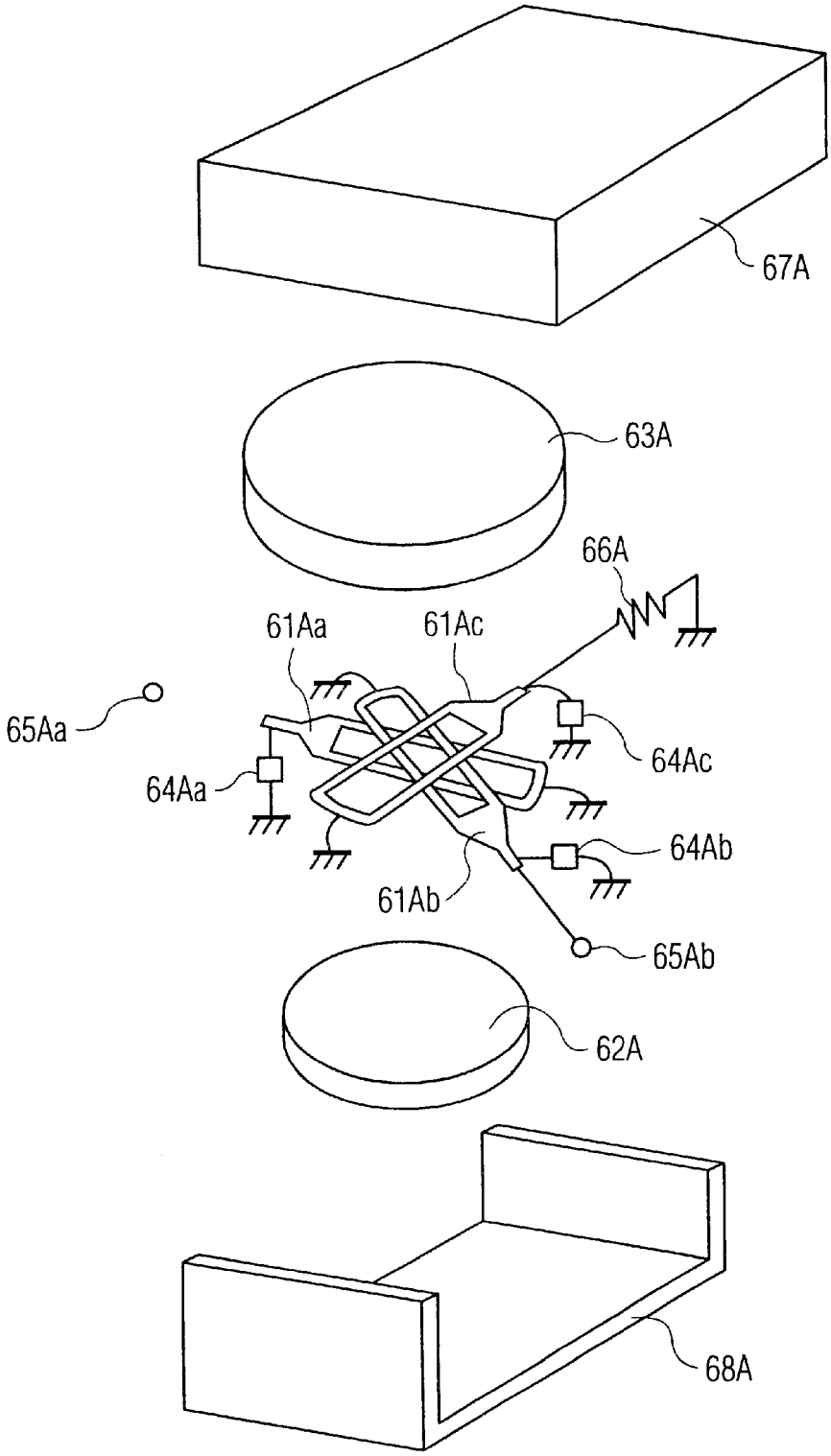
FIG. 31 PRIOR ART
FIG. 31 is a general block diagram of a conventional lumped element type isolator.

FIG. 28 shows a schematic block diagram of the 940-MHz-band isolator of a comparative example. The configuration of external-connection input/output terminals 111'A*a* and 111'A*b* and grounding terminals 113'A and 114'A is different from the case of the embodiment 1 of the second aspect of the present invention. Therefore, cases are arranged so as to have an opening in the width-axis direction of the strip line 33A to which the resistance 25 is added through the conductor 111A*c* as a-whole. The comparative example is substantially the same as the conventional lumped element type isolator shown in FIG. 31.

For the matching with the characteristic impedance of the strip line 33A depending on the direction of the opening owned by the upper case 28A and lower case 27A as a whole, the value of the resistance 25A of the embodiment 1 of the second aspect of the present invention in FIG. 26 is set to 51 Ω and that of the comparative example in FIG. 28 is set to 68 Ω.

Table 1 shows results of examining frequency bands for an isolation of −15 dB to be secured on the lumped element type isolator of the embodiment 1 in FIG. 26 and the lumped element type isolator of the comparative example in FIG. 28.

In FIG. 26, when assuming that most of signals having a frequency of 940 MHz input to the input/output terminal 111A*a* are output from the input/output terminal 111A*b*, the transmitting direction of the signals is decided as the forward direction and the opposite direction to the transmitting direction is decided as the backward direction. Similarly, in FIG. 28, when assuming that most of signals having a frequency of 940 MHz input to the input/output terminal 111'A*a* are output from the input/output terminal 111'A*b*, the transmitting direction of the signals is decided as the forward direction and the opposite direction to the transmitting direction is decided as the backward direction. In this case, Table 1 shows a result of examining the isolation of backward-directional signal transmission for each case.

TABLE 1

| | Resistance value (Ω) | −15 dB band width of isolation (MHz) | Minimum insertion loss (dB) |
|---|---|---|---|
| Embodiment 1 | 51 | 100 | 0.28 |
| Comparative example | 68 | 70 | 0.28 |

As shown in Table 1, the isolation band width of −15 dB or more of an isolator is equal to 100 MHz about 940 MHz in the case of the embodiment 1 shown in FIG. 26 but equal to 70 MHz in the case of the comparative example in FIG. 28. Thus, it is found that the isolation band width is greatly increased in the case of the isolator shown in FIG. 26.

Moreover, the insertion loss characteristic of an isolator is hardly different between the embodiment 1 and the comparative example and the minimum value is about 0.28 dB.

(Embodiment 2 of Second Aspect of the Present Invention)

Figure 29:
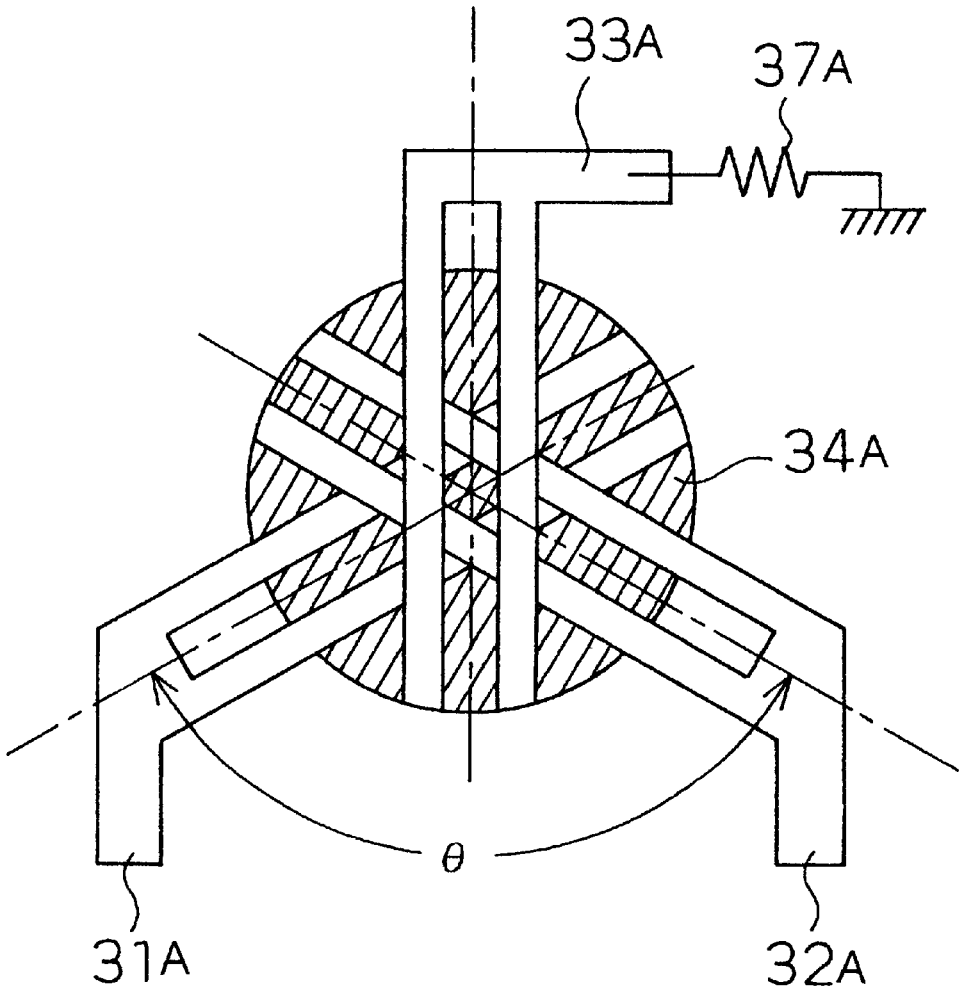
FIG. 29 is a block diagram of strip lines arranged on a ferrite disk.

In the case of the embodiment 2, electrical characteristics of an isolator are measured by changing the crossed-axes angle θ between the strip lines 31A and 32A excluding the strip line 33A to which the resistance 37A is added in the block diagram of the strip lines 31A, 32A, and 33A arranged on the ferrite disk 34A in FIG. 29.

In this case, measurement is performed by changing the crossed-axes angle θ on the both cases in which the embodiment 1 (FIG. 26) has an opening in the length-axis direction of the strip line 33A to which the resistance 37A is added as a whole and the comparative example has an opening in the width-axis direction of the strip line 33A. Moreover, in the case of the isolator of the comparative example, the upper case 28A and lower case 27A have an opening in the width-axis direction of the trip line 33A to which the resistance 37A is connected as a whole and use two types of crossed-axes angles θ of 120° and 80°.

Other configurations of the lumped element type isolators of the above embodiment 2 and comparative example are made similar to the configuration of the embodiment 1 (FIG. 26).

Table 2 shows the isolation bandwidths of −15 dB or more, insertion losses and resistance values used to match characteristic impedances of strip lines to be terminated, of the lumped element type isolators of the embodiment 2 and comparative example.

TABLE 2

| | Crossed-axes angle θ (°) | Direction of case opening | Resistance value (Ω) | −15 dB band width of isolation (MHz) | Minimum insertion loss (dB) |
|---|---|---|---|---|---|
| Comparative example | 120 | Width axis | 68 | 70 | 0.28 |
| Embodiment 2 | 110 | Width axis | 57 | 87 | 0.30 |
| Embodiment 2 | 100 | Width axis | 49 | 120 | 0.34 |
| Embodiment 2 | 90 | Width axis | 44 | 162 | 0.39 |
| Comparative example | 80 | Width axis | 39 | 197 | 0.43 |
| Embodiment 2 | 110 | Length axis | 46 | 148 | 0.30 |
| Embodiment 2 | 100 | Length axis | 40 | 192 | 0.34 |
| Embodiment 2 | 90 | Length axis | 36 | 205 | 0.39 |

From Table 2, it is found that the resistance value to match with the characteristic impedance of the strip line 33A to which the resistance 37A is added decreases and the isolation band width increases by setting the crossed-axes angle θ to less than 120°. Moreover, by setting θ to 90° or more, it is possible to decrease the minimum insertion loss to less than 0.40 dB and thus, an insertion loss enough for practical use is obtained.

Moreover, by configuring cases so as to have an opening in the length-axis direction of the strip line 33A to which the resistance 37A is added on the ferrite disk 34A as a whole as shown in the embodiment 1, it is found that a larger isolation band width can be secured at an insertion loss almost equal to the case of the arrangement having an opening in the width-axis direction.

Moreover, the embodiment 2 was described by using a case of transmitting a signal having a 940-MHz band as an example.

(Embodiment 3 of Second Aspect of the Present Invention)

Figure 30:
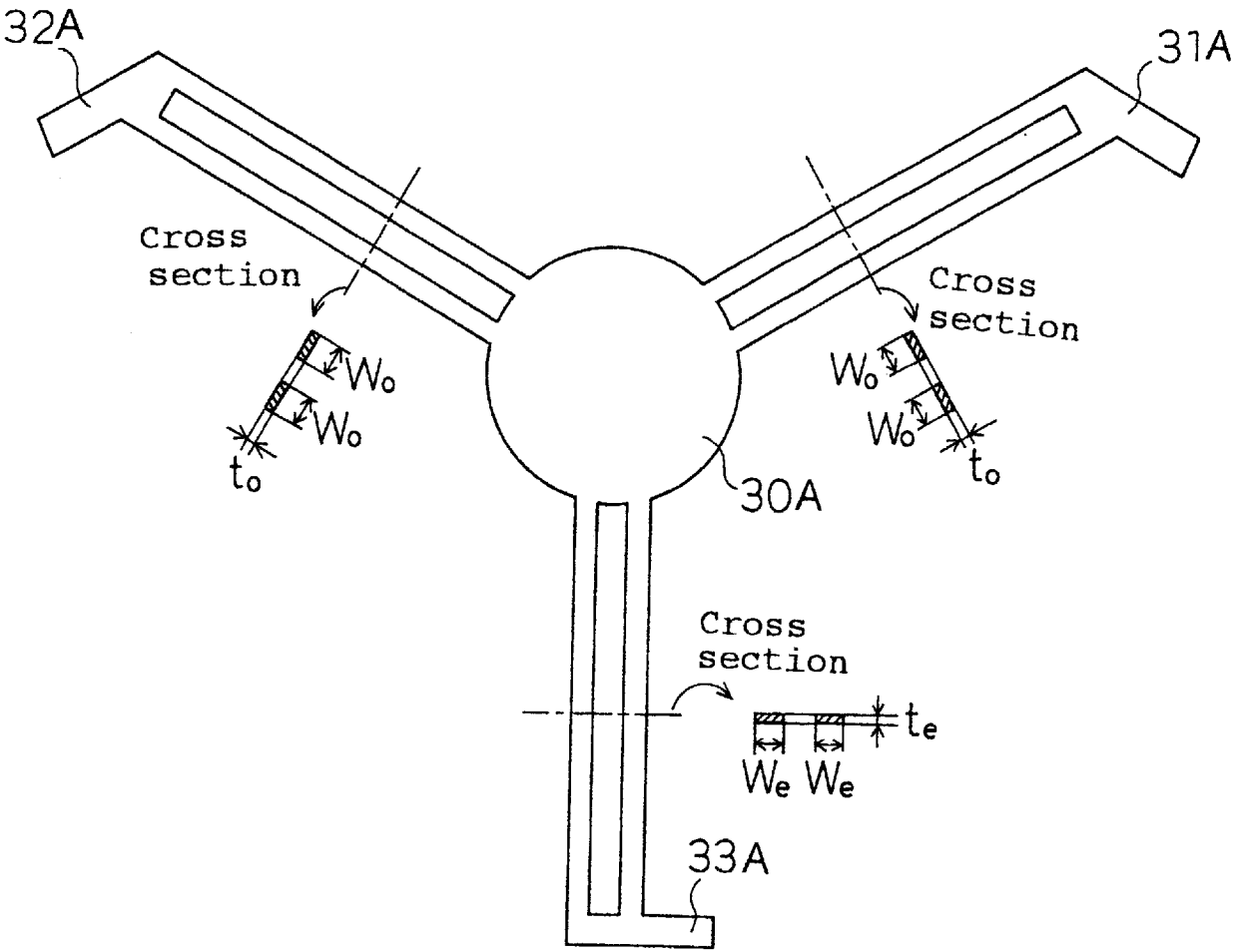
FIG. 30 is a development of a strip line.

As for the embodiment 3, electrical characteristics of an isolator are measured by making the width or thickness of each of the strip lines 31A and 32A described in FIGS. 25 and 27 of the embodiment 1 different from the width or thickness of the strip line 33A to which the resistance 25A is added. In this case, as shown by the development of strip lines in FIG. 30, it is assumed that the width of each of two lines of the strip line 33A to which the resistance 25A is added is We and the thickness of each of the two lines is te, and the widths and thicknesses of the two lines are substantially equal to each other. Moreover, it is assumed that the width of each of two lines of each of two other strip lines 31A and 32A is W0 and the thickness of each of the two lines is t0, and the widths and thicknesses of the two lines of each of the strip lines 31A and 32A are equal to each other.

Then, by changing W0 for We and W0 for te, electric characteristics of an isolator are measured. In this case, the upper and lower cases 28 and 27 are measured on the both cases in which the embodiment 1 (FIG. 26) has an opening in the length-axis direction of the strip line 33A to which the resistance 25A is added as a whole and the comparative example (FIG. 28) has an opening in the width-axis direction of the strip line 33A.

Moreover, the comparative example uses an isolator in which the upper case 28A and the lower case 27A have an opening in the width-axis direction of the strip line 33A to which the resistance 25A is added as a whole.

Other configurations of the lumped element type isolators of the above embodiment 3 and comparative example are made similar to the configuration of the embodiment 1 (FIG. 26).

Table 3 shows isolation band widths of −15 dB or more, insertion losses, and resistance values used to match characteristic impedances of strip lines to be terminated of the lumped element type isolators of the above embodiment 3 and comparative example.

TABLE 3

| | We (mm) | WO (mm) | te (μm) | tO (μm) | Direction of case opening | Resistance value (Ω) | −15 dB band width of isolation (MHz) | Minimum insertion loss (dB) |
|---|---|---|---|---|---|---|---|---|
| Comparative example | 0.3 | 0.3 | 50 | 50 | Width axis | 68 | 73 | 0.31 |
| Embodiment 3 | 0.3 | 0.25 | 50 | 50 | Width axis | 51 | 103 | 0.28 |
| Comparative Example | 0.25 | 0.3 | 50 | 50 | Width axis | 81 | 64 | 0.30 |
| Comparative Example | 0.25 | 0.25 | 50 | 50 | Width axis | 68 | 70 | 0.28 |
| Embodiment 3 | 0.25 | 0.25 | 100 | 50 | Width axis | 60 | 83 | 0.28 |
| Comparative Example | 0.25 | 0.25 | 50 | 100 | Width axis | 74 | 65 | 0.28 |
| Embodiment 3 | 0.3 | 0.25 | 50 | 50 | Length axis | 43 | 163 | 0.28 |
| Embodiment 3 | 0.25 | 0.25 | 100 | 50 | Length axis | 48 | 113 | 0.28 |

From Table 3, it is found that by setting We larger than W0, the resistance value to match with the characteristic impedance of the strip line 33A to which the resistance 25A is added decreases and the isolation band width increases. Moreover, it is found that by setting te larger than t0, the isolation band width also increases. Furthermore, it is found that by configuring cases so as to have an opening in the length-axis direction of the strip line 33A to which the resistance 25A is added on the ferrite disk 34A as a whole, a large isolation band width can be secured compared to the case of the arrangement having an opening in the width-axis direction.

The embodiment 3 is also described by using a case of transmitting a signal of a 940-MHz band as an example.

Moreover, in case of the above embodiments 1 to 3, strip lines 31A, 32A, and 33A are respectively configured by two lines. However, it is permitted that each strip line is configured by of one line or three lines or more.

For example, when the strip line 33A is configured by of one line, the width of the strip line 33A is equal to one line width. However, as shown for the embodiment 3, when the strip line 33A is configured by two lines or more, it is assumed that the width of the strip line 33A is the sum of actual line widths excluding the spatial portion of two line widths or more. Similarly, it is assumed that the width of each of the strip lines 31A and 32A is the sum of actual line widths excluding the spatial portion of one line width or a plurality of line widths. In this case, when the width of the strip line 33A is larger than the widths of the strip lines 31A and 32A, the isolation band width increases. Moreover, when the width of the strip line 33A is larger than the widths of the strip lines 31A and 32A and the width of the strip line 31A is substantially equal to the width of the strip line 32A, the isolation band width increases.

Furthermore, when the strip line 33A is configured by one line, the thickness of the strip line 33A is equal to the thickness of one line. However, as shown for the embodiment 3, when the strip line 33A is configured by two lines or more, it is assumed that the thickness of the strip line 33A is equal to the average of two lines or more. Furthermore, it is assumed that the thickness of each of the strip lines 31A and 32A is equal to the thickness of one line or the average of thicknesses of a plurality of lines. In this case, when the thickness of the strip line 33A is larger than thicknesses of the strip lines 31A and 32A, the isolation band width increases. Moreover, when the thickness of the strip line 33 is larger than thicknesses of the strip lines 31A and 32A and the thickness of the strip line 31A is substantially equal to that of the strip line 32A, the isolation band width increases.

The above embodiments 1 to 3 were described by using an isolator of a 940-MHz band widely used for transmission by domestic portable telephone terminals at present as an example. However, the second aspect of the present invention is not restricted to the 940-MHz band. The second aspect is also effective for an isolator designed for 1.5-GHz band or 1.9-GHz band.

As described above, the second aspect of the present invention provides a lumped element type isolator having a large isolation band width.

Then, embodiments of the third aspect of the present invention will be described below by referring to the accompanying drawings.

Figure 32:
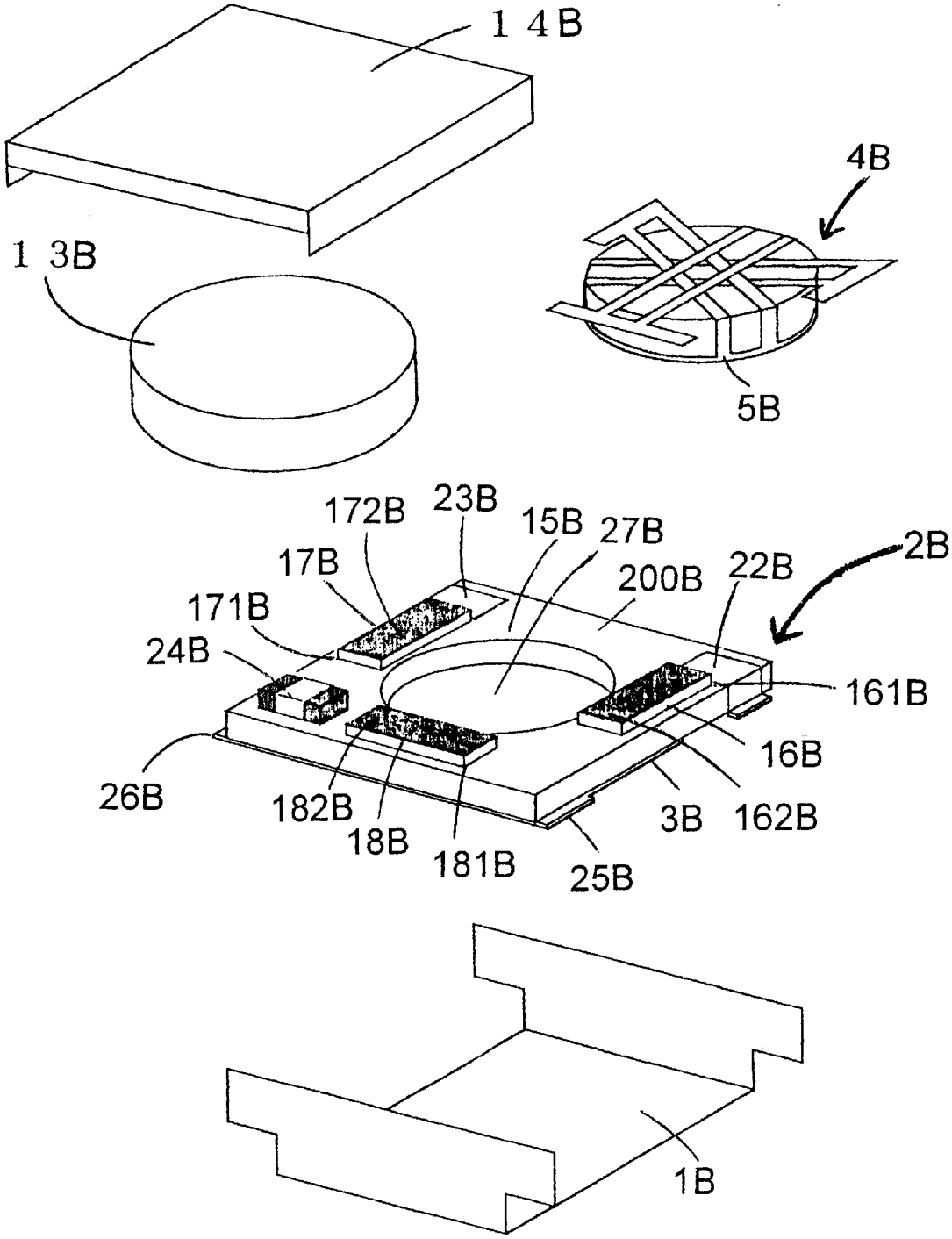
FIG. 32 is a structural view of the non-reciprocal circuit element of the third aspect of the present invention.
Figure 33:
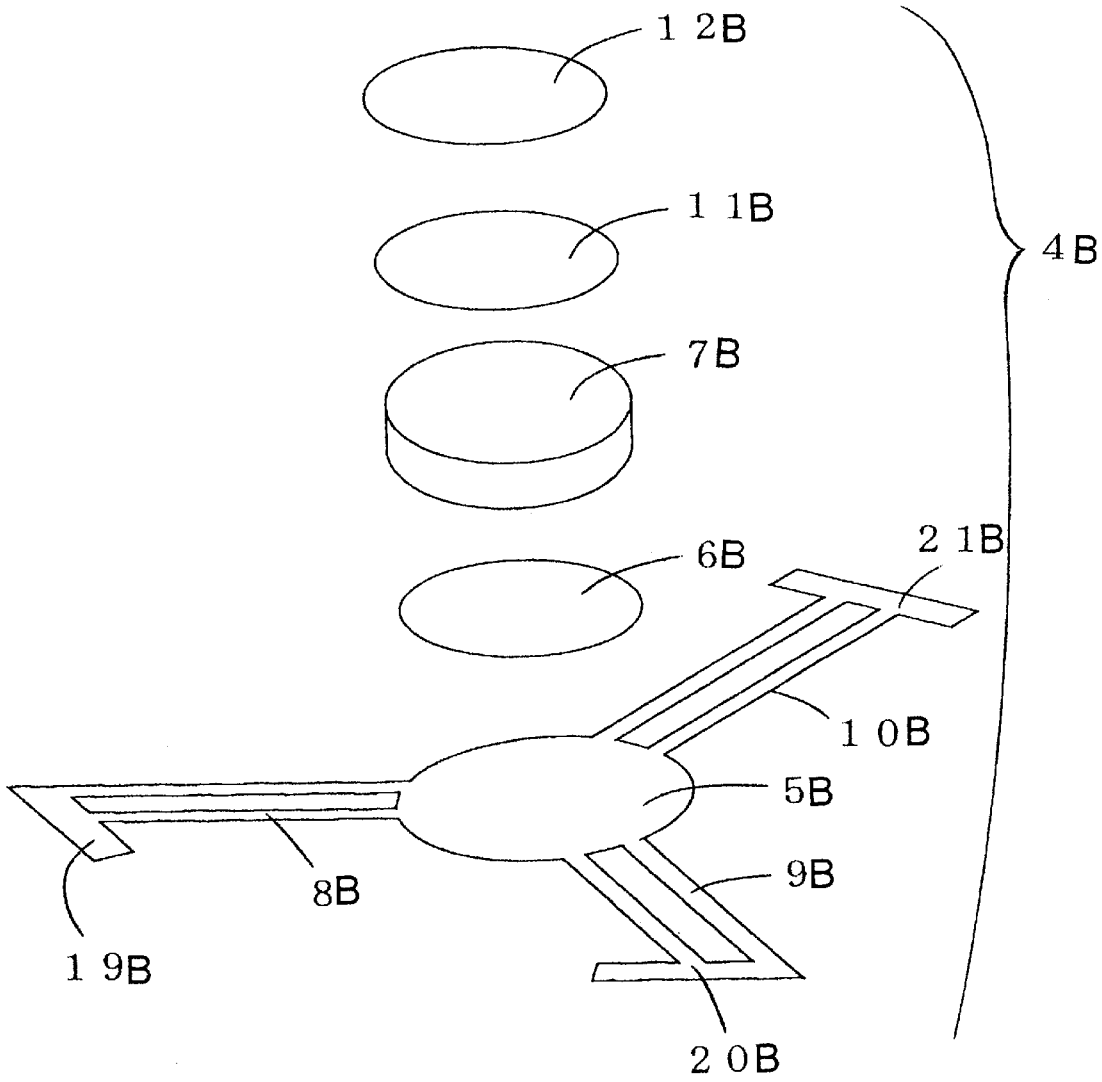
FIG. 33 is a structural view of the central conductor portion of the third aspect of the present invention.

FIGS. 32 and 33 are illustrations for explaining the configuration of an isolator serving as a non-reciprocal circuit element of the embodiment 1 of the third aspect of the present invention. A circular grounding plate 5B is soldered to the inside of a case lower-side 1B made of a metallic magnetic material by solder-connecting a grounding-electrode plane 3B side of the back of a dielectric substrate 2B onto the case lower-side 1B and inserting a central conductor portion 4B into the central hole 27B of the dielectric substrate 2B. A hole same as the central hole 27B of the dielectric substrate 2B is formed on the grounding-electrode plane 3B.

As shown in FIG. 33, the central conductor portion 4B is set by setting a dielectric layer 6B between the circular grounding plate 5B and a ferrite disk 7B and moreover, insulating three strip lines 8B, 9B, and 10B each other through insulating sheets 11B and 12B, crossing them every 120°, and bending them along the upper side of the ferrite disk 7.

A DC magnetic field is applied to the ferrite disk 7B by a permanent magnet 13B in the direction vertical to the plane of the disk 7B. In this case, the permanent magnet 13B is set to the opposite side to the ferrite disk 7B, when viewed from the strip lines 8B, 9B, and 10B and put in the case upper-side 14B made of a metallic magnetic material so as to contact the inside of the upper side 14B.

Matching capacitors 16B, 17B, and 18B are solder-connected to three electrodes 161B, 171B, and 181B formed on the upper side 15B of the dielectric substrate 2B. These three electrodes are connected to the grounding-electrode plane 3B on the back of the dielectric substrate 2B by through-holes in the body 200B of the substrate 2B.

Connection terminals 19 (B), 20B, and 21B at ends of the strip lines 8B, 9B, and 10B bent on the ferrite disk 7B are solder-connected to upper-side terminals 162B, 172B, and 182B of the matching capacitors 16B, 17B, and 18B. Moreover, 19(B) and 20B among these terminals are connected to external connection input/output terminals 22B and 23B respectively by the extended portion of each strip line terminal.

A terminating resistance 24 is connected to the matching capacitor 18B in parallel and the other end of the capacitor 18B is grounded. External connection terminals 25B and 26B are connected to the grounding electrode 3B formed on the back of the dielectric substrate 2B. The case upper-side 14B made of a metallic magnetic material is put on the permanent magnet 13B so as to overlap the case lower-side 1B with the end and then, the overlapped portion is connected by solder.

Figure 34:
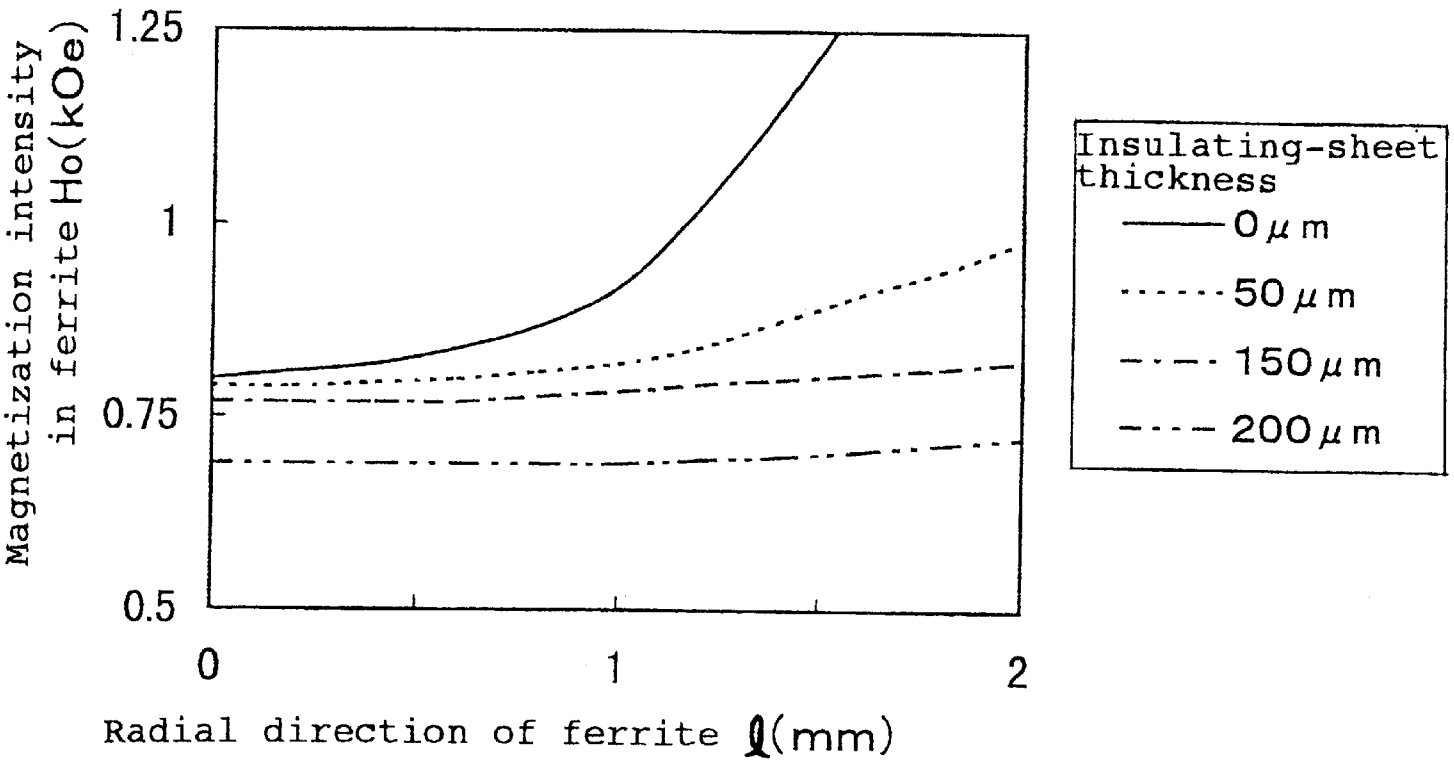
FIG. 34 is a graph showing radial magnetization distributions of a ferrite disk.

FIG. 34 shows radial magnetization distributions of the ferrite disk 7B when changing distances between the lower side of the ferrite disk 7B and the circular grounding plate 3B by changing thicknesses of the dielectric layer 6B in this embodiment. As the distance is changed from 50 to 150 $\mu$m, magnetization distributions in the ferrite are improved. However, when the distance reaches 200 $\mu$m, the entire magnetization intensity of the ferrite disk 7B is decreased.

Figure 35:
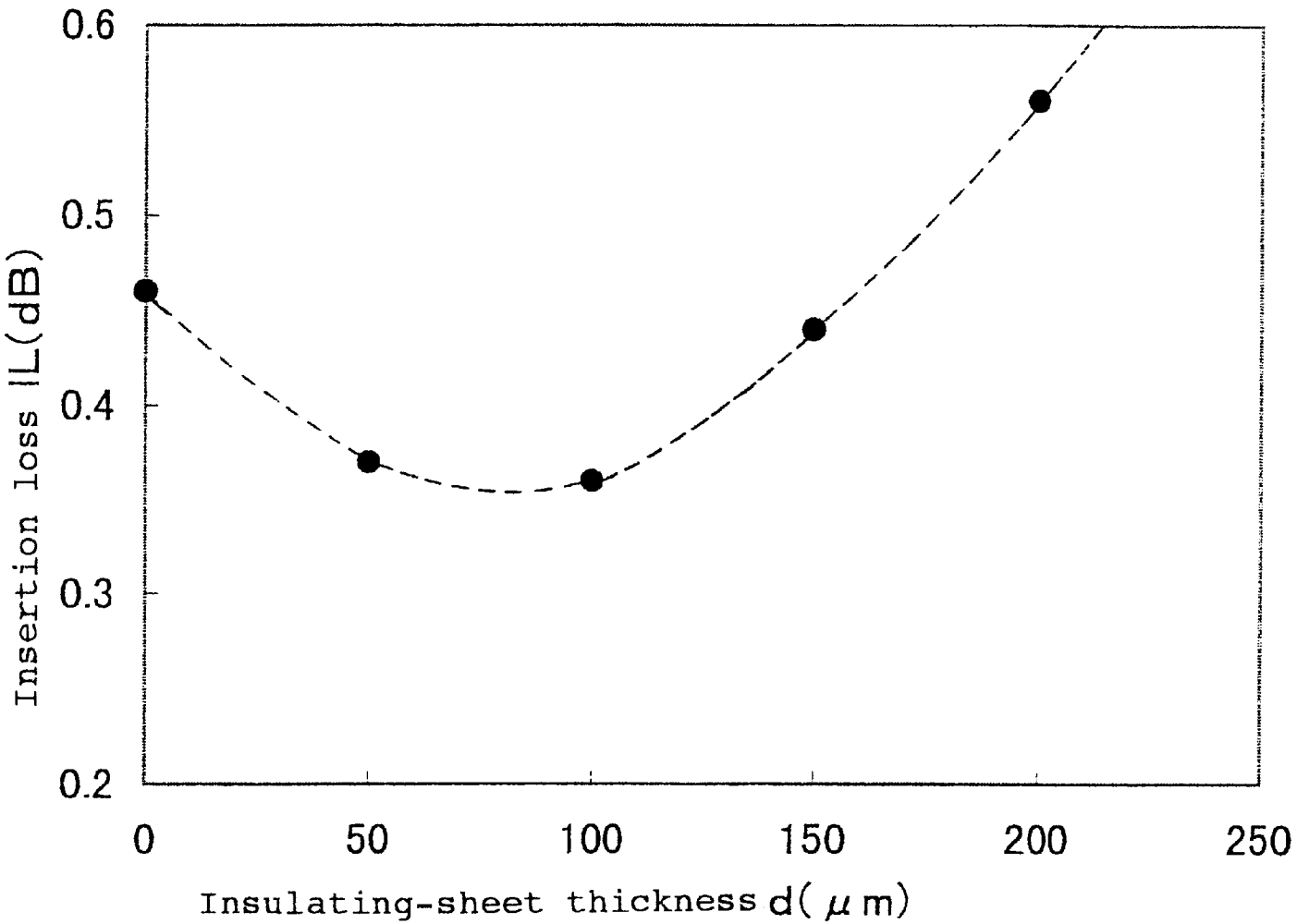
FIG. 35 is a graph of the insertion loss showing the distance dependency of the bottom of a ferrite disk and the lower side of a case.

Moreover, FIG. 35 shows the state of isolator insertion losses when changing the above distance by changing thicknesses of the dielectric layer 6B. When the distance reaches 200 $\mu$m, the insertion loss is impaired. This is because the distance increases and the magnetization intensity of the ferrite disk 7B is decreased. By enhancing the permanent magnet 13B, the insertion loss can be slightly improved. However, a preferable characteristic in the case of 50 to 150 $\mu$cannot be obtained.

FIGS. 34 and 35 show the results of study when changing thicknesses of the dielectric layer 6B made of polyimide or Teflon between the ferrite disk 7B and the case lower-side inside 3B. When using glass epoxy used for a normal circuit board for the dielectric layer 6B, the insertion loss is further impaired than the former case. This is because a dielectric loss in a high frequency increases.

Figure 36:
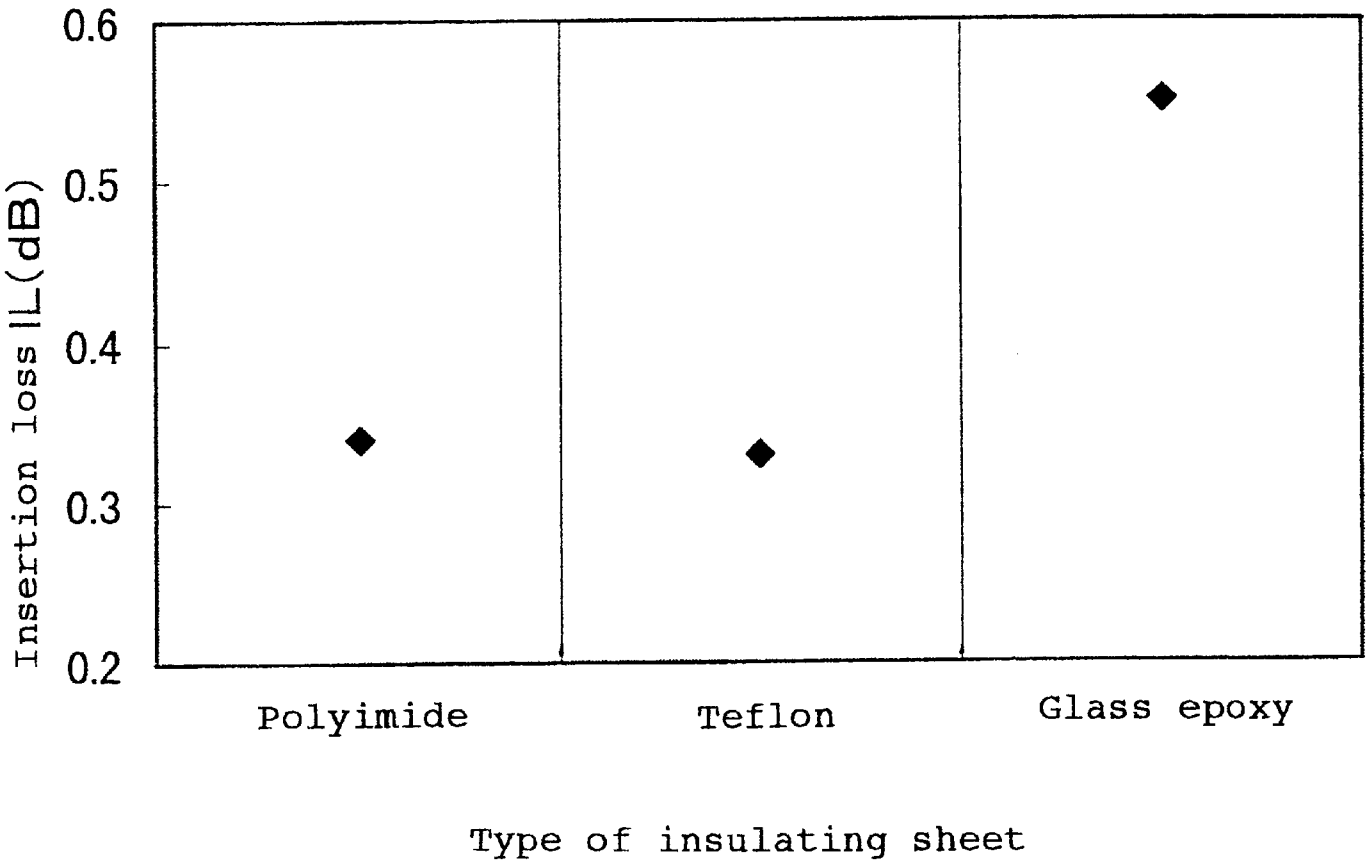
FIG. 36 is a graph showing insertion losses when inserting polyimide, Teflon, and glass-epoxy films respectively having a thickness of 100 $\mu$m between the bottom of a ferrite disk and the lower side of a case.

FIG. 36 shows the comparison between insertion losses of an isolator at a distance of 100 $\mu$m when using three types of materials such as polyimide, Teflon, and glass epoxy.

It is permitted that the dielectric layer 6B has an sticky adhesive at its both sides and it is previously bonded to the lower side of ferrite or a grounding plane facing the lower side of ferrite.

As described above, the third aspect of the present invention provides a non-reciprocal circuit element capable of stably showing a high performance while the circuit element is reduced in size and thickness.

What is claimed is:

1. A mounting substrate for a non-reciprocal circuit element comprising:

(a) at least two input/output land patterns to which external input/output terminals for inputting/outputting signals are connected as land patterns on which the non-reciprocal circuit element is mounted and (b) at least one grounding land pattern to which external ground terminals are connected as land patterns on which the non-reciprocal circuit element is mounted, and (c) said mounting substrate having an upper surface; and said non-reciprocal circuit element configured as an assembly and having a bottom surface;

wherein said bottom surface of the assembly is mounted on the upper surface of the mounting substrate;

said assembly having at least a ferrite and transmission lines folded over the ferrite; and at least two external input/output terminals for transferring a signal to and from an external unit; and at least one of the external grounding terminals for grounding, wherein at least one of the external grounding terminals is set between the two external input/output terminals; and a part of the at least one grounding land pattern is set between the at least two input/output land patterns.

2. A method of mounting a circuit for non-reciprocally transmitting a signal on a substrate, comprising the steps of:

(a) forming the circuit as an assembly having at least a ferrite and transmission lines folded over the ferrite;

(b) forming at least two input/output land patterns for input and output terminals on the mounting substrate;

(c) forming at least one grounding land pattern for a grounding terminal on the mounting substrate, and positioning the ground land pattern between the two input/output land patterns;

(d) connecting the transmission lines to the input/output land patterns on the mounting substrate; and (e) connecting the circuit to the least one grounding land pattern on the mounting substrate.

3. The method of claim 2 in which step (c) includes forming the at least one grounding land pattern at one end of the mounting substrate; and forming additional grounding land patterns at an opposing end of the mounting substrate.

4. The method of claim 3 in which the additional grounding land patterns formed at the opposing end of the mounting substrate are formed free-of any input/output land pattern.

* * * * *

UNITED STATES PATENT AND TRADEMARK OFFICE

CERTIFICATE OF CORRECTION

PATENT NO. : 6,531,930 B2
DATED : March 11, 2003
INVENTOR(S) : Horio et al.

It is certified that error appears in the above-identified patent and that said Letters Patent is hereby corrected as shown below:

Column 18,
Line 3, between “the” and “least” insert -- at --.

Signed and Sealed this

Ninth Day of September, 2003

JAMES E. ROGAN
*Director of the United States Patent and Trademark Office*